US007218293B2

(12) United States Patent
Kato

(10) Patent No.: US 7,218,293 B2
(45) Date of Patent: May 15, 2007

(54) METHOD FOR DRIVING AN ORGANIC ELECTROLUMINESCENT DISPLAY DEVICE

(75) Inventor: Naoki Kato, Kanagawa (JP)

(73) Assignee: OPTREX Corporation, Tokyo (JP)

( * ) Notice: Subject to any disclaimer, the term of this patent is extended or adjusted under 35 U.S.C. 154(b) by 485 days.

(21) Appl. No.: 10/774,382

(22) Filed: Feb. 10, 2004

(65) Prior Publication Data

US 2004/0217926 A1 Nov. 4, 2004

(30) Foreign Application Priority Data

Feb. 10, 2003 (JP) ..... 2003-033006

(51) Int. Cl.
*G09G 3/30* (2006.01)
*G09G 3/20* (2006.01)

(52) U.S. Cl. ..... 345/76; 345/82

(58) Field of Classification Search ..... 345/76–83; 315/169.3

See application file for complete search history.

(56) References Cited

U.S. PATENT DOCUMENTS

| | | | | |
|---|---|---|---|---|
| 5,844,368 | A | 12/1998 | Okuda et al. | |
| 6,376,994 | B1 | 4/2002 | Ochi et al. | |
| 6,774,878 | B2 * | 8/2004 | Yoshida et al. | 345/76 |
| 6,914,388 | B2 * | 7/2005 | Shin et al. | 315/169.2 |
| 7,019,720 | B2 * | 3/2006 | LeChevalier | 345/82 |
| 2001/0048410 | A1 | 12/2001 | Nishigaki et al. | |
| 2004/0160393 | A1 * | 8/2004 | Kato | 345/80 |

FOREIGN PATENT DOCUMENTS

| | | |
|---|---|---|
| JP | 9-232074 | 9/1997 |
| JP | 11-45071 | 2/1999 |
| JP | 2000-214824 | 8/2000 |
| JP | 2001-35655 | 2/2001 |
| JP | 2001-331149 | 11/2001 |
| JP | 2002-328651 | 11/2002 |

* cited by examiner

*Primary Examiner*—Dennis-Doon Chow
(74) *Attorney, Agent, or Firm*—Oblon, Spivak, McClelland, Maier & Neustadt, P.C.

(57) ABSTRACT

When the ambient temperature of an organic electroluminescent display device is a low temperature, a capacitive charge driving method is performed to supply a constant current to a column electrode after performing capacitance charge and then apply a constant voltage to the column electrode to turn off a pixel; and when the ambient temperature is room temperature or a high temperature, an electric charge control driving method is performed to supply a constant current to the data electrode and then place the column electrode in a high impedance state. In the electric charge control driving method, a driving section is set in a selection period so as to be shorter than the selection period, and the amount of electric charges supplied to the pixel in the driving section is controlled depending on a required luminance.

4 Claims, 13 Drawing Sheets

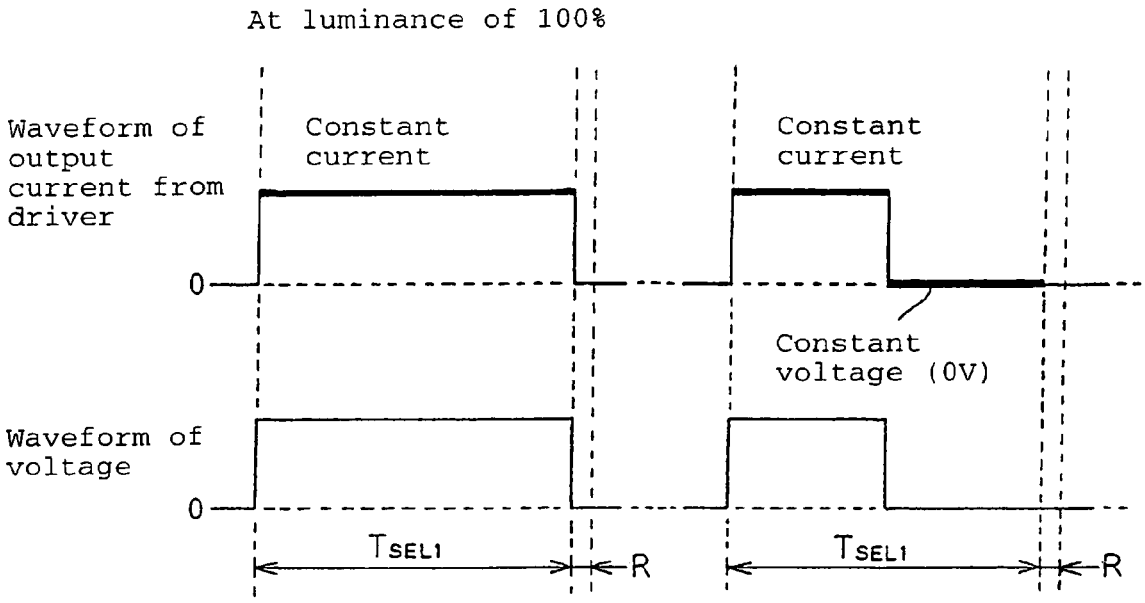
FIG. 1A
FIG. 1B
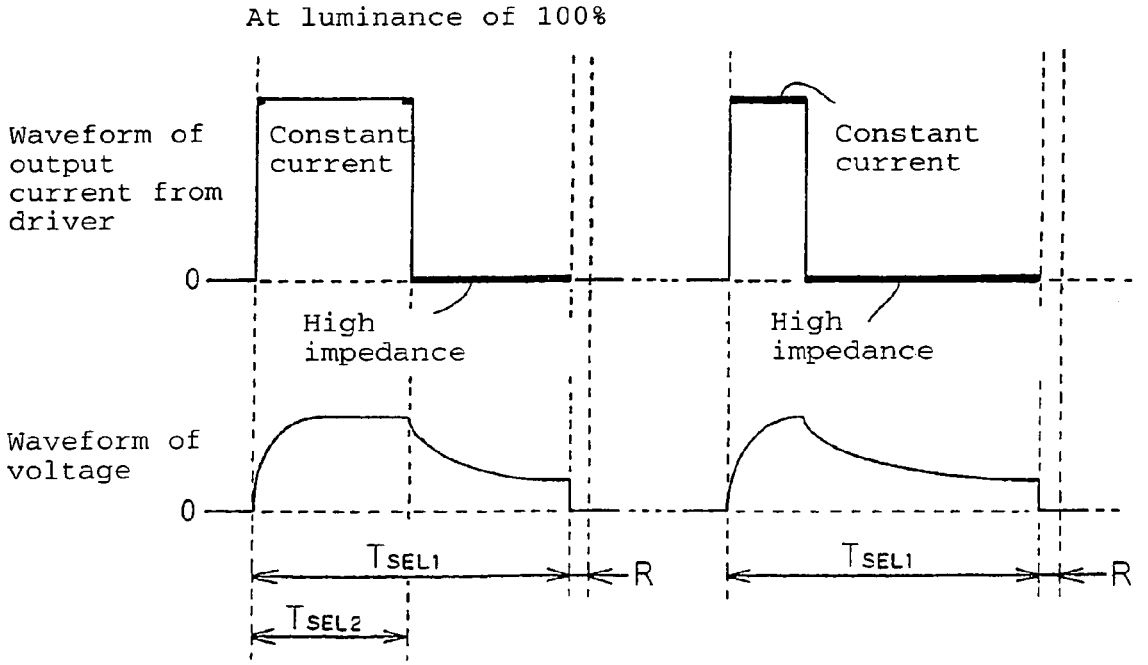
FIG. 1C
FIG. 1D

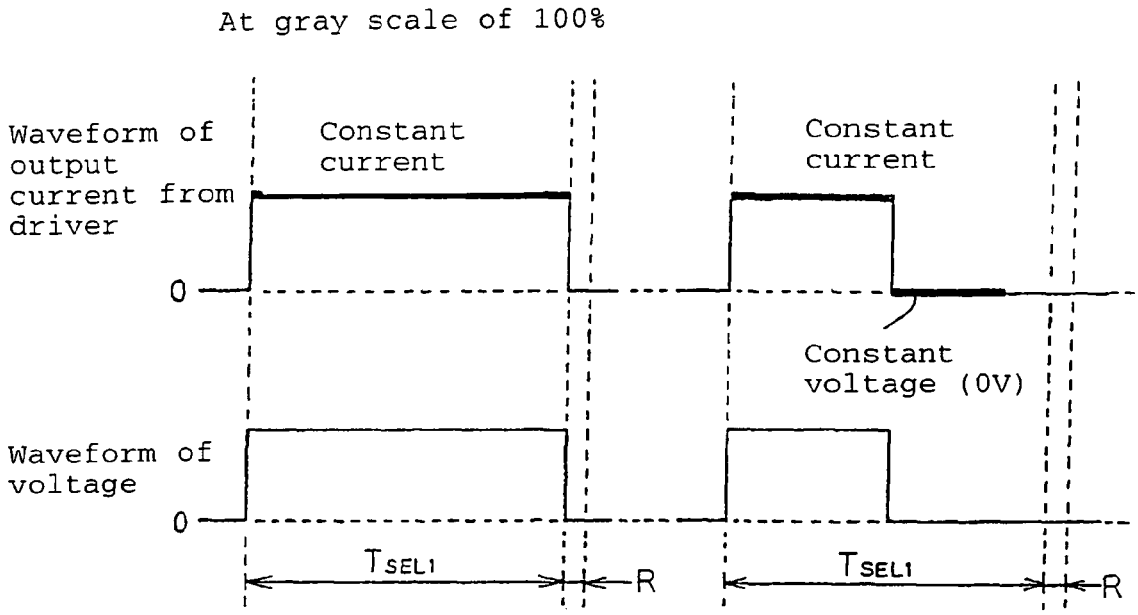
FIG. 9A
FIG. 9B
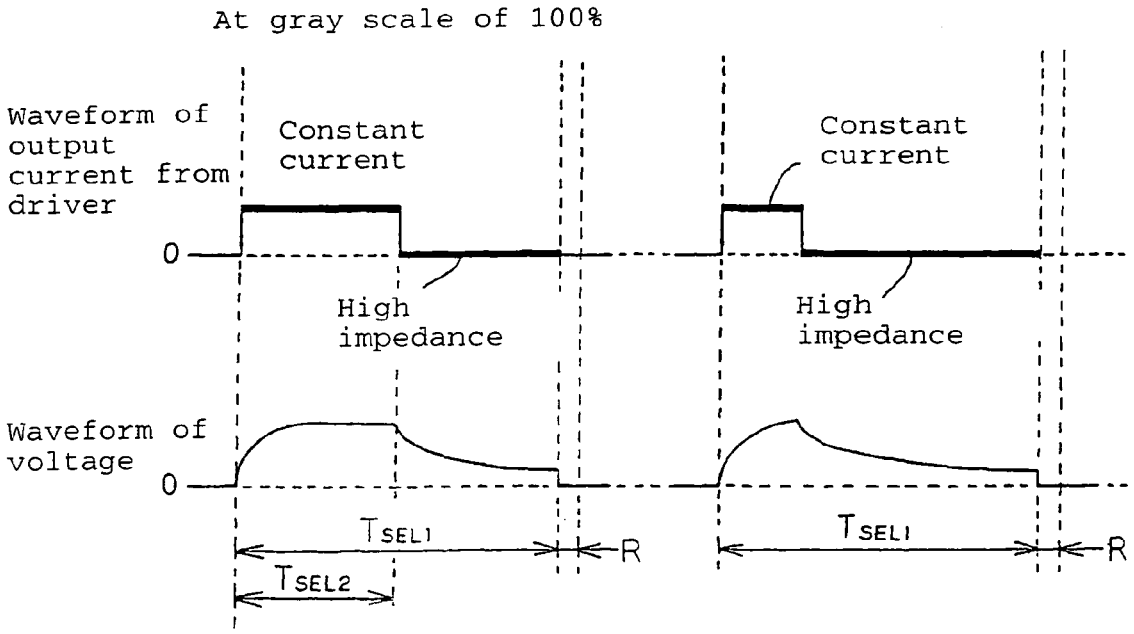
FIG. 9C
FIG. 9D

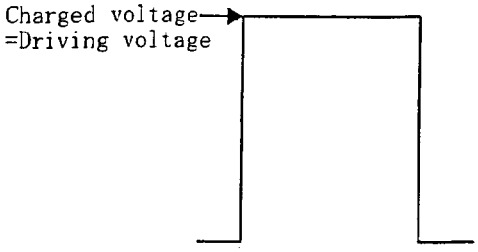
FIG. 14A
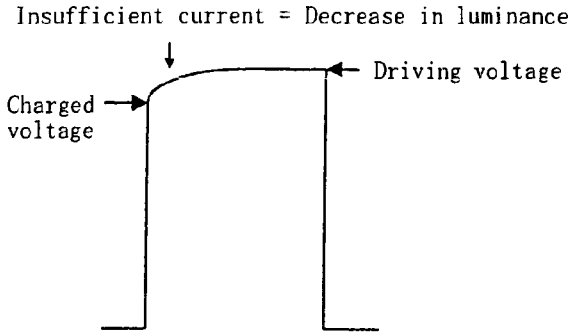
FIG. 14B
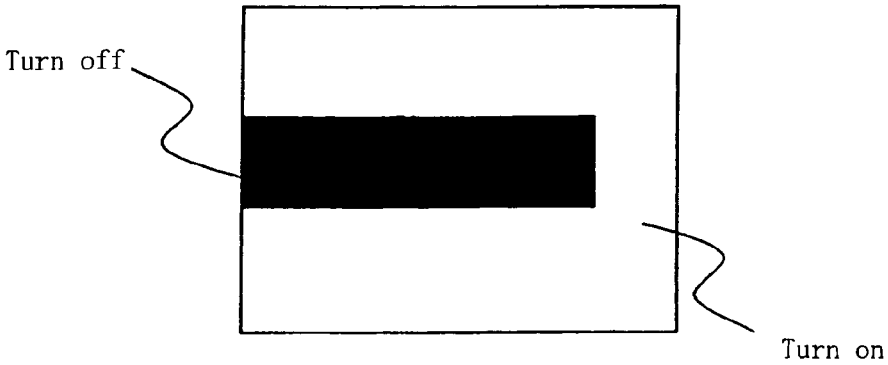
FIG. 15A Image to be displayed
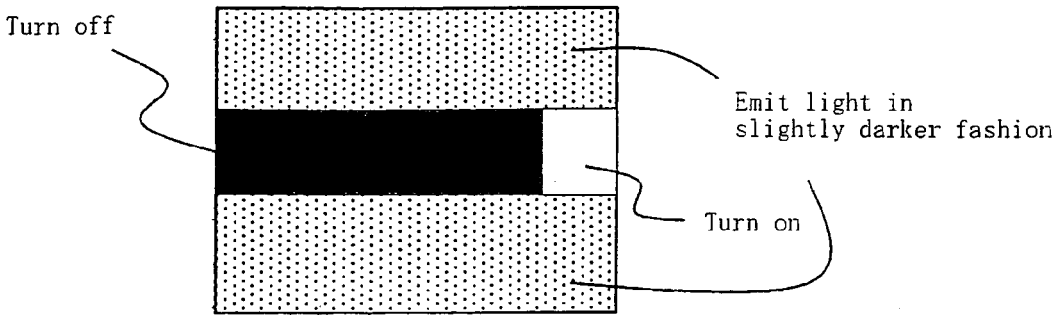
FIG. 15B Actually displayed image

METHOD FOR DRIVING AN ORGANIC ELECTROLUMINESCENT DISPLAY DEVICE

BACKGROUND OF THE INVENTION

1. Field of the Invention

The present invention relates to a method for driving an organic electroluminescent display device, which uses an organic electroluminescent light emitting element (hereinbelow, referred to as organic electroluminescent element).

2. Discussion of Background

An organic electroluminescent display device has an organic electroluminescent element sandwiched between an anode and a cathode. The organic electroluminescent element, which is sandwiched between both electrodes, has unnegligible capacitance formed therein. The organic electroluminescent element has properties similar to semiconductor light emitting diodes. When the anode side of the organic electroluminescent element is provided on a higher voltage side, and when a certain voltage is applied across both electrodes to supply a current to the organic electroluminescent element, the organic electroluminescent element emits light. Conversely, when the cathode side of the organic electroluminescent element is provided on a higher voltage side, the organic electroluminescent element does not emits light since almost no current flows. For this reason, the organic electroluminescent element is also called an organic light emitting diode in some cases.

When a constant voltage is applied across an organic electroluminescent element, the luminance of the organic electroluminescent element greatly varies, depending on a change in temperature or a change with time. However, the width of variations in the luminance of an organic electroluminescent element is small with respect to the value of currents. In order to obtain required display intensity, it is common to use a constant-current driving method wherein a constant-current circuit is provided in a drive circuit to supply a constant current to respective organic electroluminescent elements.

An organic electroluminescent display device, which has an organic electroluminescent element provided in each of pixels of matrix electrodes, is available. FIG. 10(*a*) and FIG. 10(*b*) are a schematic perspective view and a schematic cross-sectional view of the organic electroluminescent display device. There are provided a set of anode strips 2 connected to an anode or forming an anode per se, and a set of cathode strips 1 connected to a cathode or forming a cathode per se, which extend in a direction perpendicular to the anode strips. When the cathode strips 1 form a cathode per se, and when the anode strips 2 form an anode per se, an intersection between a cathode strip 1 and an anode strip 2 forms a pixel, and an organic thin film (organic electroluminescent element) 3 is sandwiched between both electrodes. In this manner, pixels, which are formed by organic electroluminescent elements, are provided in a matrix fashion and in a planar fashion on a glass substrate 6.

A technique for performing display of an organic electroluminescent display device by passive matrix addressing is explained. In explanation below, one of the set of the cathode strips 1 and the set of the anode strips 2 works as scanning electrodes, and the other works as data electrodes. The respective scanning electrodes are connected to a scanning driver, which is provided with a constant-voltage circuit. By this arrangement, constant-voltage drive is performed with respect to the scanning electrodes. The scanning electrodes are sequentially scanned so that one of the scanning electrodes is in a selected state with a selection voltage applied and the remaining scanning electrodes are in a non-selected state without the selection voltage applied. In general, the scanning electrodes are sequentially scanned to have a certain drive voltage applied to pixels from the scanning electrode at one end of the set of the scanning electrodes to the scanning electrode at the other end so that one scanning electrode has the selection voltage applied thereto in every selection period and so that all scanning electrodes are scanned in a certain period.

The data electrodes are connected to a data driver, which has a constant-current circuit provided at an output stage. Display data, which correspond to the display pattern of selected scanning electrodes, are supplied to all data electrodes in synchronization with the scanning of the scanning electrodes. A current pulse, which is supplied to data electrodes from the constant-current circuit, flows in a selected scanning electrode through organic electroluminescent elements, which are located at the intersections between the selected scanning electrode and the data electrodes.

The pixel made of an organic electroluminescent element emits light only in a period wherein the scanning electrode with that pixel connected thereto is selected and there is current supply from the data electrode. When the current supply from the data electrode stop, the light emission also stops. While a current supply is being made to the organic electroluminescent elements sandwiched between the set of the data electrodes and the set of the scanning electrodes in this manner, all scanning electrodes are sequentially scanned in a repetitive fashion. In accordance with a desired display pattern, the emission and the non-emission of light is controlled with respect to the pixels of the entire display screen.

For driving an organic electroluminescent panel, the set of the anode strips 2 and the set of the cathode strips 1 of the organic electroluminescent panel may be provided so that one of the sets works as the scanning electrodes or the data electrodes. In other words, the anode strips 2 are used as the scanning electrodes while the cathode strips 1 are used as the data electrodes. Or, the anode strips 2 are used as the data electrodes while the cathode strips 1 are used as the scanning electrodes. Both sets of the electrodes have interchangeability in terms of driving the organic electroluminescent panel. The setting of the scanning electrodes and the data electrodes may be made in consideration of the polarity of organic electroluminescent elements. Generally, it is common that the data electrodes correspond to the anode strips 2 and the scanning electrodes correspond to the cathode strips 1. Hereinbelow, explanation of the driving and the display of the organic electroluminescent display device will be made about a case wherein the cathode strips 1 works as the scanning electrodes and the anode strips 2 work as the data electrodes. In explanation below, irrespective of the upper and lower directions and the right and left directions when a viewer sees a display screen, the array of pixels that extend parallel with the scanning electrodes will be also called "row", while the array of pixels that extend parallel with the data electrodes will be also called "column". One wherein scanning electrodes and data electrodes are provided on an organic electroluminescent element or organic electroluminescent elements will be called an organic electroluminescent panel.

First, the scanning electrodes need to satisfy the following electric potential condition. Specifically, the potential of a scanning electrode in the selected state need to be lower than the potential of a scanning electrode in the non-selected state. For the purpose, driving is performed so that the potential of a scanning electrode in the selected state is set at ground (earth) potential so as to provide a scanning electrode in the non-selected state with a higher potential than the ground potential.

When output data are turn-on data for turning on a pixel, the data electrode relevant to that pixel on the column side is supplied with a constant current, when output data are turn-off data for turning off a pixel, the data electrode relevant to that pixel on the column side are supplied with a constant voltage equal to ground potential. In other words, the data electrodes are configured so as to be switched between a constant-current output and a constant-voltage output, depending on whether a pixel is turned on or off. The reason why a relevant data electrode is supplied with the constant current output is that the luminance is controlled by the value of a current as stated earlier.

The direction of a current, which flows in an organic electroluminescent element, is set so that the current flows from the data electrode as an anode strip 2 to the scanning electrode as a cathode strip 1 through the organic thin film 3. For this reason, the potential of the data electrodes is set so as to be higher than ground potential as the potential of a scanning electrode in the selected state.

As shown in the equivalent circuit diagram of FIG. 11, organic electroluminescent elements exhibit not only an electrical property as diodes but also a capacitive characteristic. By supplying the current to a desired pixel from the data driver having the constant-current circuit, light is emitted from the pixel made of an organic electroluminescent element, which is in a row with the selection voltage applied thereto. However, the pixels that are in non-selected rows without the selection voltage applied thereto simultaneously need to be capacitively charged.

When the number of the pixels, which are connected to one data electrode, increases according to an increase in the number of rows of the matrix forming a display screen, the current required for charging the capacitance of all pixels reaches an unnegligible value. As a result, the current that flows in a selected pixel in a row with the selection voltage applied thereto decreases to providing the luminance with a lower value than the expected value.

In order to solve this problem, there has been proposed a driving method wherein all scanning electrodes are preset at an equal potential once, or the organic electroluminescent element of each of pixels is precharged so as to have a certain potential. Presetting all scanning electrodes at an equal potential or precharging the organic electroluminescent element of each of pixels to have a certain potential will be referred to "the capacitive charge". When a pixel is energized to emit light with the maximum luminance (a luminance of 100%) after performing the capacitive charge, the data electrode relevant to that pixel is supplied with a current over substantially the full-length of the selection period. In other words, a pixel to emit light is supplied with the current over substantially the full-length of the selection period. After that, a constant voltage is applied to the data electrode relevant to the pixel to turn off the pixel. Hereinbelow, such a driving method will be referred to as the capacitive charge driving method. The capacitive charge driving method is a driving method that includes dealing with the potential of column electrodes so as to be able to flow a desired constant current through a pixel from the start of the supply of the constant current in a broad sense.

Several kinds of driving methods have been proposed as the capacitive charge driving method. A first method is a driving method wherein when driving is switched from one scanning electrode to the next one, all scanning electrodes are set at an equal potential once, and then charging is started at the equal potential for driving (see, e.g., JP-A-9-232074, paragraph 0024 to paragraph 0032 and FIG. 1 to FIG. 4). Hereinbelow, the first driving method will be referred to as the reset driving method.

A second method is a driving method wherein a charging circuit in addition to the constant current circuit is further provided on the data driver side, and the organic electroluminescent element of each of pixels is precharged only for a certain time period. The luminance is improved by increasing the driving voltage for the organic electroluminescent element (see, e.g., JP-A-11-45071, paragraph 0022 to paragraph 0029 and FIG. 2). Hereinbelow, the second driving method will be referred to as the precharge driving method.

A third method is a driving method wherein in the idle period between a scanning period and the next scanning period, a large current flows through a data electrode to be driven in the next scanning period to charge the parasitic capacitance of the respective pixels or discharge the charge having the reverse direction (see, e.g., JP-A-2001-331149, paragraph 0014). Hereinbelow, the third driving method will be referred to as the current boost driving method.

FIG. 13 shows a basic driving waveform in a case wherein the display pattern shown in FIG. 12 is displayed on a 4×4 matrix display screen having pixels positioned in columns $C_1$, $C_2$, $C_3$ and $C_4$ and in rows $R_1$, $R_2$, $R_3$ and $R_4$. Now, a driving method wherein the time width of an output current pulse from the data driver is modified will be explained.

As shown in FIG. 13, the current pulse is supplied so as to have a pulse width occupying substantially the full width of the selection period with respect to a pixel, which is required to emit light with the maximum luminance (a luminance of 100%). The current pulse is supplied so as to have a pulse width occupying a half width in comparison with the case of a luminance of 100% with respect to a pixel, which is required to emit light with a luminance of 50%. After that, the data electrode is connected to the constant-voltage source for supplying a voltage to turn off the pixel. This driving method is called pulse width modulation (hereinbelow, also referred to as PWM).

In the conventional driving methods, pixels are actually driven after capacitive charge as stated earlier. When the voltage that is applied to the pixels at the time of completion of capacitive charge (charged voltage) fails to reach the voltage that is applied to the data electrodes at the time of driving a pixel (driving voltage), the difference between the charged voltage and the driving voltage causes a decrease in luminance in some cases. FIG. 14(*a*) shows an example of the applied voltage, which is applied to a pixel to emit light with a luminance of 100% or a luminance of nearly 100%. In FIGS. 14(*a*) and 14(*b*), the time period for supplying a constant current is indicated in the horizontal direction, and an applied voltage is indicated in the vertical direction. The rising edge of each applied voltage is located at the time when capacitive charge has been completed.

When the charged voltage has the same value as the driving voltage as shown in FIG. 14(*a*), selected pixels have a desired current immediately flowing therethrough. However, when the charged voltage is lower than the driving voltage as shown in FIG. 14(*b*), other pixels in the same column that are not selected also have a current flowing therethrough even after completion of capacitive charge until the applied voltage has reached the value of the driving voltage. As a result, the pixels to emit light are short of electric charges, lowering the luminance. When the driving voltage is lower than the charged voltage, the other pixels in the same column that are not selected also have a current flowing out thereof into the selected pixels even after completion of capacitive charge. As a result, the selected pixels have an excessive amount of electric charges, increasing the luminance.

Since the cathode strips 1 have a certain level of resistance, the amount of the current that flows into the cathode varies depending on the number of pixels to emit light per one row. As a result, the cathode potential varies depending on the variation of a display pattern. Even when pixels emit light with a relatively high luminance, such as a luminance of 100% or a luminance of nearly 100%, chrominance non-uniformity is caused in a horizontally striped shape according to a display pattern, depending on the variation of a display pattern and the difference between the charged voltage and the driving voltage, as shown in FIG. 15(*b*). This type of display state is called horizontal cross-talk. FIG. 15(*b*) shows a case wherein although an attempt is made to turn off a portion of the display screen and emit light from the remaining portions with a luminance of 100% as shown in FIG. 15(*a*), the luminance becomes darker than expected since the cathode potential in a row having a large number of pixels to turn on increases to prevent a certain level of current from flowing the organic electroluminescent elements forming the pixels to turn on.

When light emission is made with a low luminance by PWM and so on, the problem of horizontal cross-talk becomes a big issue. FIGS. 16(*a*) and 16(*b*) show examples of the applied voltage for turning on a pixel by PWM. In FIGS. 16(*a*) and 16(*b*), the time period for supplying a constant current is indicated in the horizontal direction, and each applied voltage is indicated in the vertical direction.

When the charged voltage has the same value as the driving voltage as shown in FIG. 16(*a*), selected pixels have a desired level of current immediately flowing therethrough. However, when the charged voltage has a different value from the driving voltage as shown in FIG. 16(*b*), other pixels in the same column that are not selected also have a current flowing therethrough even after completion of capacitive charge until the applied voltage has reached the value of the driving voltage. When a pixel is energized to emit light with a low luminance as shown in FIG. 16(*b*), the time period for supplying a current to the relevant data electrode ends before the applied voltage has reached the same value as the driving voltage. In this case, the pixel emits light with a lower luminance than a desired luminance (required luminance). When all pixels have the same current-voltage characteristics in an organic electroluminescent display device, the luminance of the device uniformly lowers over the entire screen. However, in a case wherein the pixels have different current-voltage characteristics, the respective pixels have different values of currents flowing therethrough, failing to provide a uniform luminance over the entire screen even when the pixels have the same voltage applied thereacross. The current-voltage characteristics of a pixel means the relationship between a voltage applied to a pixel and a current flowing through the pixel.

In a case wherein there are variations in the current-voltage characteristics, i.e., wherein pixels have different currents flowing therethrough by application of a voltage, a pixel emits light with the required luminance and another pixel emits light with a lower luminance in spite of that all pixels to emit light are energized so as to emit light with the same luminance by constant-current drive. This creates a problem of chrominance non-uniformity wherein the luminance varies to portion from portion to such degree that can be visually recognized.

This also created a problem that the degree of the horizontal cross-talk generated becomes greater than a case wherein desired pixels are energized to emit light with a luminance of 100% or a relatively high luminance close to 100%.

When capacitive charge is performed to all pixels of an organic electroluminescent element, additional power is required for capacitive charge. This creates a problem that even when a display pattern needs a small number of pixels to emit light, the power consumption for the pixels cannot be reduced to a lower value than the power consumption required for capacitive charge.

In order to solve these problems, the inventor has proposed an electric charge control driving method wherein a data electrode in an organic electroluminescent panel is placed in a high impedance state after a constant current is supplied to the date electrode from a constant-current circuit. In the electric charge control driving method, a driving section is set in a selection period so as to have a shorter length than the selection period, and the amount of electric charges, which are supplied to pixels in the driving section, is controlled so as to correspond to required luminance. The electric charges that have been accumulated in the capacitance of the pixels in the driving section are controlled so as to be supplied to selected pixels in a non-driving section in the selection period.

When the capacitive charge is not performed, an amount of currents that flow through the pixels in a period from start of drive to a time when an anode voltage has reached a driving voltage is small, and the luminance is lower than an expected value in that period as stated earlier. In accordance with the electric charge control driving method, it is possible to uniform the luminance amount in the selection period with respect to required luminance by controlling the amount of electric charges supplied to the pixels according to the required luminance. Thus, it is possible to reduce variations in luminance, and it is therefore possible to suppress the occurrence of horizontal cross-talk.

However, in the case of using the electric charge control driving method, it is necessary to increase the driving current and the driving voltage since the energizing time is shorter than the capacitive charge driving method. For this reason, when an organic electroluminescent display device is fabricated so as to have an operable temperature range widened in the case of using the electric charge control driving method, it is necessary to provide a driving circuit having a high output voltage.

SUMMARY OF THE INVENTION

It is an object of the present invention to provide a method for driving an organic electroluminescent display device, which is capable of suppressing the occurrence of horizontal cross-talk or chrominance non-uniformity without increasing a driving current and a driving voltage and without avoiding an increase in the costs of a drive circuit in an organic electroluminescent display device.

In order to attain the object, in accordance with the driving method according to the present invention, the electric charge control driving method and a driving method without using the electric charge control driving method are selectively performed, depending on operating conditions. In other words, when the occurrence of horizontal cross-talk or chrominance non-uniformity does not cause a quite serious problem, and when the driving voltage is increased by using the electric charge control driving method, the driving method without using the electric charge control is performed. When the driving voltage is not increased in spite of using the electric charge control driving method, the electric charge control driving method is performed.

According to a first aspect of the present invention, there is provided a method for driving an organic electroluminescent display device, which has a set of row electrodes and a set of column electrodes provided in a matrix pattern, and an organic electroluminescent element sandwiched between both sets; comprising driving the organic electroluminescent element by a capacitive charge driving method when an ambient temperature is not higher than a prescribed temperature, the capacitive charge driving method comprising supplying a constant current to a column electrode after performing capacitance charge and then applying a constant voltage to the column electrode to turn off a pixel; and driving the organic electroluminescent element by an electric charge control driving method when the ambient temperature is higher than the prescribed temperature, the electric charge control driving method comprising supplying electric charges to the column electrode and then placing an output from a driving circuit to the column electrode in a high impedance state.

According to a second aspect of the present invention, a maximum voltage of a supply voltage of the driving circuit under the electric charge control driving method is not higher than that under the capacitive charge driving method in the driving method according to the first aspect.

According to a third aspect of the present invention, the prescribed temperature is in a temperature range of from −10° C. to +10° C. in the method according to the first or second aspect.

According to a fourth aspect of the present invention, a grayshade satisfies Formulas 1 to 3 listed below, electric charges on a first term of a right side of Formula 1 are supplied by capacitive charge, and electric charges of a second term of the right side are supplied by application of a constant current in the driving method according to any one of the first to third aspects:

$$Q_1=C_{colm}\cdot V_1+I_1\cdot T_{SEL1} \quad \text{Formula 1}$$

$$Q_2=I_2\cdot T_{SEL2} \quad \text{Formula 2}$$

$$I_2\cdot T_{SEL2}-C_{colm}\cdot V_2\approx I_1\cdot T_{SEL1} \quad \text{Formula 3}$$

wherein a capacitance of one column of the organic electroluminescent element is $C_{colm}$; when the electroluminescent element is driven by the capacitive charge driving method, an amount of electric charges supplied to the column electrode from the driving circuit is $Q_1$, a driving voltage in a constant current section for supplying the constant current to the column electrode is $V_1$, a driving current in the constant current section is $I_1$, and a length of the constant section is $T_{SEL1}$; and when the electroluminescent element is driven by the electric charge control driving method, the amount of electric charges supplied to the column electrode from the driving circuit is $Q_2$, a voltage between a row electrode and the column electrode on completion of the high impedance state is $V_2$, the driving current in the constant current section for supplying the electric charges to the column electrode is $I_2$, and a length of the constant current section is $T_{SEL2}$, in the method according to any one of the first to third aspects.

According to a fifth aspect of the present invention, there is provided a method for driving an organic electroluminescent display device, which has a set of row electrodes and a set of column electrodes provided in a matrix pattern, and an organic electroluminescent element sandwiched between both sets; comprising driving the organic electroluminescent element by a capacitive charge driving method when a light-emission luminance in a maximum gray scale is a relatively high luminance, the capacitive charge driving method comprising supplying a constant current to a column electrode after performing the capacitance charge, and then applying a constant voltage to the column electrode to turn off a pixel; and driving the organic electroluminescent element by an electric charge control driving method when the light-emission luminance in the maximum gray scale is a relatively low luminance, the electric charge control driving method comprising supplying electric charges to the column electrode and then placing an output from a driving circuit to the column electrode in a high impedance state.

According to a sixth aspect of the present invention, when a rated luminance is defined as 100%, a light-emission luminance when switching between both driving methods has a value of 40% to 60% of the rated luminance in the method according to the fifth aspect.

According to a seventh aspect of the present invention, the current applied to the organic electroluminescent element at the low luminance is not greater than that applied at a rated light-emission in the method according to the fifth or sixth aspect.

According to an eighth aspect of the present invention, a grayshade satisfies Formulas 4 to 6 listed below, electric charges on a first term of a right side of Formula 4 are supplied by capacitive charge, and electric charges of a second term of the right side are supplied by application of the constant current in the method according to any one of the fifth to seventh aspects:

$$Q_1=C_{colm}\cdot V_1+I_1\cdot T_{SEL1} \quad \text{Formula 4}$$

$$Q_2=I_2\cdot T_{SEL2} \quad \text{Formula 5}$$

$$R_{DIM}=(I_2\cdot T_{SEL2}-C_{colm}\cdot V_2)/(I_1\cdot T_{SEL1}) \quad \text{Formula 6}$$

wherein a capacitance of one column of the organic electroluminescent element is $C_{colm}$; when the electroluminescent element is driven by the capacitive charge driving method, an amount of electric charges supplied to the column electrode from the driving circuit is $Q_1$, a driving voltage in a constant current section for supplying the constant current to the column electrode is $V_1$, a driving current in the constant current section is $I_1$, and a length of the constant current section is $T_{SEL1}$; and when the electroluminescent element is driven by the electric charge control driving method, the amount of electric charges supplied to the column electrode from the driving circuit is $Q_2$, a voltage between a row electrode and the column electrode on completion of the high impedance state is $V_2$, the driving current in the constant current section for supplying the electric charges to the column electrode is $I_2$, and the length of the constant current section is $T_{SEL2}$; and wherein (a luminance when being driven by the electric charge control method)/(a luminance when being driven by the capacitive charge driving method) in the grayshade is $R_{DIM}$.

According to a ninth aspect of the present invention, there is provided a method for driving an organic electroluminescent display device, which has a set of row electrodes and a set of column electrodes provided in a matrix pattern, and an organic electroluminescent element sandwiched between both sets; comprising driving the organic electroluminescent element by an electric charge control driving method when an ambient temperature is higher than a prescribed temperature, the electric charge control driving method comprising supplying electric charges to a column electrode and then placing an output from a driving circuit to the column electrode in a high impedance state; driving the organic electroluminescent element by the electric charge control driving method when the ambient temperature is not higher than the prescribed temperature and when a light-emission luminance in a maximum gray scale is a relatively low luminance; and driving the organic electroluminescent element by a capacitive charge driving method when the ambient temperature is not higher than the prescribed temperature and when the light-emission luminance in the maximum gray scale is a relatively high luminance, the capacitive charge driving method comprising supplying a constant current to the column electrode after performing the capacitance charge, and then applying a constant voltage to the column electrode to turn off a pixel.

According to a tenth aspect of the present invention, when the ambient temperature is not higher than the prescribed temperature and when a rated luminance is defined as 100%, a light-emission luminance when switching between both driving methods has a value of 40% to 60% of the rated luminance in the method according to the ninth aspect.

According to an eleventh aspect of the present invention, the prescribed temperature is included in a temperature range of from −10° C. to 10° C. in the ninth or tenth aspect.

According to a twelfth aspect of the present invention, a maximum voltage of a supply voltage of the driving circuit is not higher than 25 V in the method according to any one of the first to eleventh aspects.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 1(*a*) to 1(*d*) are schematic views showing the driving method according to a first typical example of the present invention;

FIGS. 9(*a*) to 9(*d*) are schematic views showing the driving method according to a second typical example of the present invention;

FIGS. 14(*a*) and 14(*b*) are waveform diagrams showing examples of voltages applied to a pixel according to a conventional method;

FIGS. 15(*a*) and 15(*b*) are explanatory diagrams showing how horizontal cross-talk is caused.

DETAILED DESCRIPTION OF THE PREFERRED EMBODIMENTS

Now, embodiments according to the present invention will be described, referring to the accompanying drawings. FIGS. 1(*a*) to 1(*d*) are schematic views showing the driving method according to the present invention. In each of FIGS. 1(*a*) to 1(*d*), an upper half section shows the waveform of an output current from a data driver, and a lower half section shows the waveform of an anode voltage (the waveform of a voltage of anode strips). In FIGS. 1(*a*) to 1(*d*), "R" designates an idle period between a selection period ($T_{SEL1}$) and the next selection period.

The driving method shown in FIGS. 1(*a*) and 1(*b*) is a driving method, which performs the capacitive charge stated earlier, and which, when a selected pixel is energized to emit light with the maximum luminance (a luminance of 100%) of an organic electroluminescent panel, supplies a current to the data electrode over the full length of the selection period, and when a selected pixel is energized to emit light with a lower luminance than the maximum luminance, supplies a current to the data electrode only in a section corresponding to the required luminance in the selection period and applies a constant voltage (voltage to prevent a current from flowing through the pixel, e.g., 0 V) across the pixel in the remaining section. The driving method shown in FIGS. 1(*c*) and 1(*d*) is a driving method using the electric charge control driving, i.e., the electric charge control driving method. The driving period for supply of a constant current and the time period in the high impedance state shown in FIGS. 1(*c*) and 1(*d*) will be called a constant current section and a high impedance section in some cases, respectively. In FIGS. 1(*b*) and 1(*d*) are shown a case wherein the driving method according to the present invention is applied to PWM in order to obtain grayshade.

Now, the driving method that supplies a current to a selected pixel over the full length of the selection period when the pixel is required to emit light with the maximum luminance as shown in FIGS. 1(*a*) and 1(*b*) will be called a first driving method, and the electric charge control method is called a second driving method. In the present invention, the first driving method and the second driving method are selectively performed, depending on operating conditions.

Figure 2:
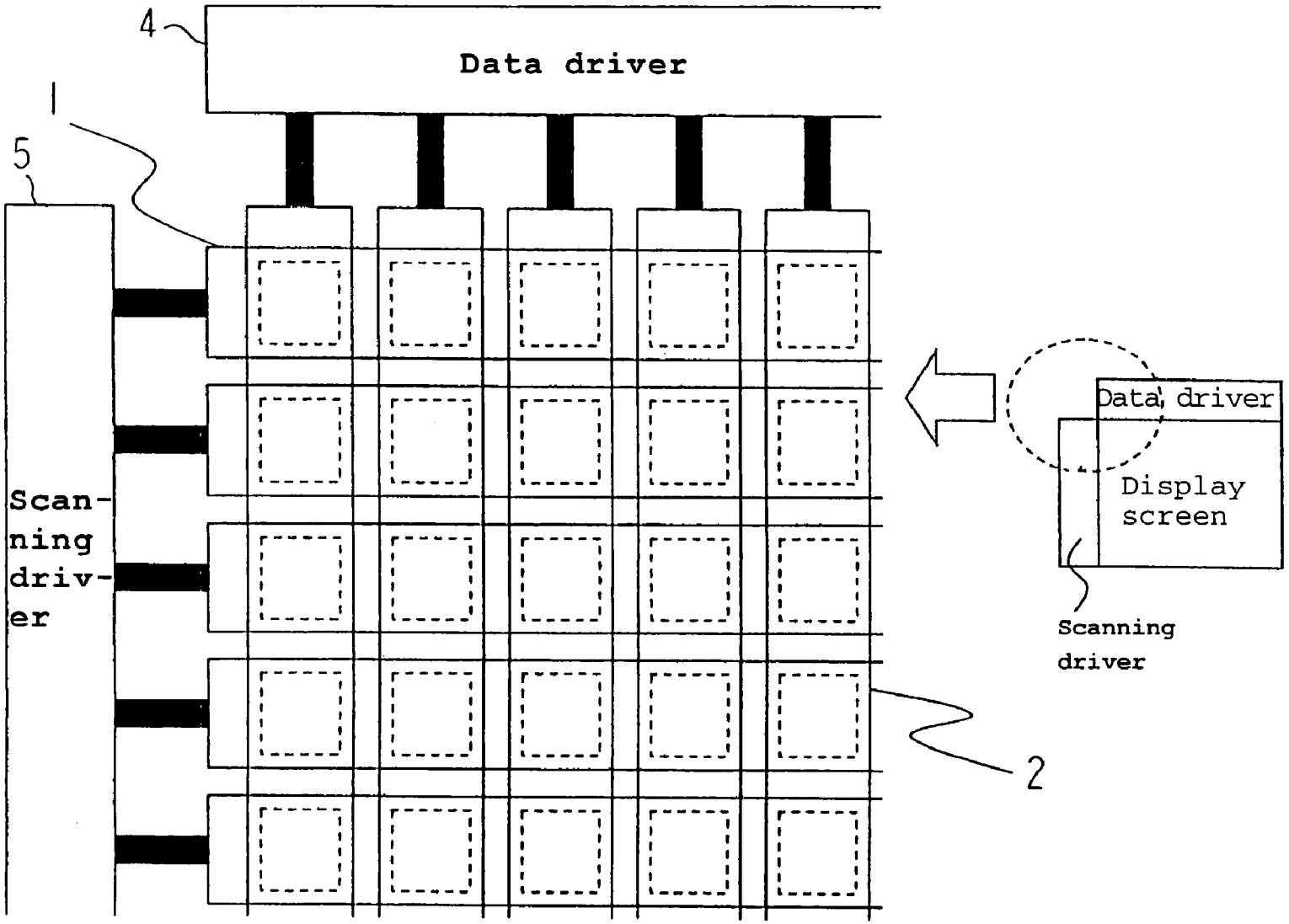
FIG. 2 is a schematic view showing how electrodes are provided in an organic electroluminescent display device.
Figure 3:
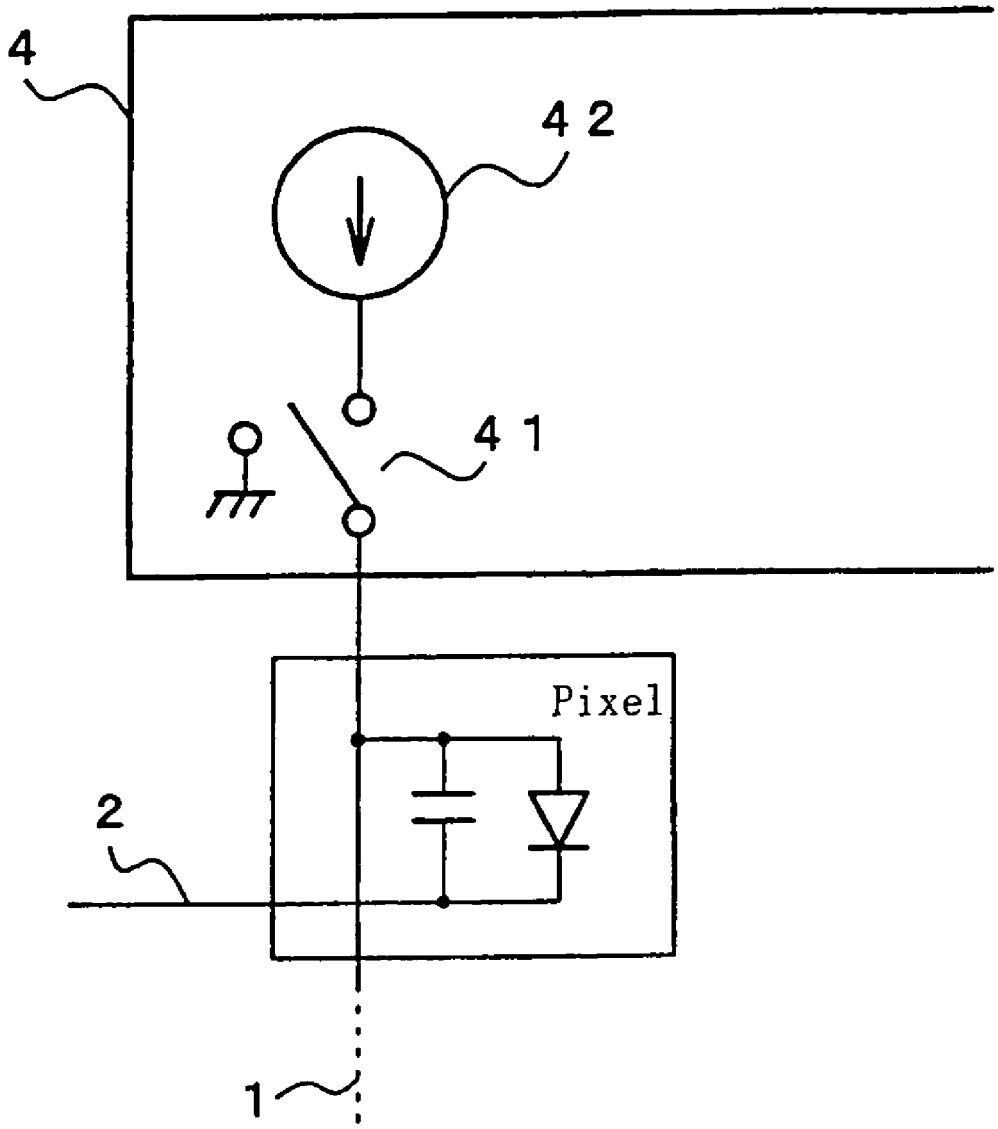
FIG. 3 is a schematic view showing the driving portion for one column in a data driver and pixels.

FIG. 2 is a schematic view showing how electrode strips are provided in an organic electroluminescent display device. FIG. 3 is a schematic view showing the driving portion for one column in a data driver and pixels.

Referring to FIG. 2, a set of cathode strips 1 as scanning electrodes and a set of anode strips 2 as data electrodes are provided in a matrix fashion so as have an organic thin film (not shown in FIG. 2) sandwiched therebetween. The data driver 4 provides a constant current to anode strips 2 as data electrodes on driving. A scanning driver 5 provides a selection voltage to cathode strips 1 as scanning electrodes to be selected. As shown in FIG. 3, the anode strips 2 as the data strips can take any one of a state to be connected to a constant-current circuit 42 incorporated in a driver IC as the data driver 4, a state to be connected to ground potential and a state to be disconnected from either one (a high impedance state), by a switching element 41, such as a FET incorporated in the driver IC. The driver IC includes not only the data driver 4 but also the scanning driver 5 in some cases. The anode strips are connected to ground potential only in the idle period. In this embodiment, the data electrodes correspond to the column electrodes, and the scanning electrodes correspond to the row electrodes.

In the first driving method, when pixels are energized to emit light with the maximum luminance (a luminance of 100%) by passive matrix addressing, a selected pixel (a pixel connected to a cathode strip 1 with the selection voltage applied thereto) is provided with a constant current from the beginning to the end of the selection period after completion of capacitive charge as shown in FIG. 1(*a*). When pixels are energized to emit light with a luminance of 50%, a selected pixel is provided with the constant current in a section occupying 50% of the selection period, and the anode strip 2 is at, e.g., ground potential to prevent the selected pixel from being energized in the remaining section occupying 50% of the selection period as in the example of a driving waveform shown in FIG. 1(*b*).

On the other hand, in the second driving method, when pixels are energized to emit light with a luminance of 100% by passive matrix addressing, the switch 41 is placed in the state to connect the constant-current circuit 42 and the anode strip 2 to provide a selected pixel with the constant current in a certain section in the selection period. In the remaining section of the selection period, the switch 41 is placed in the state to disconnect the constant-current circuit 42 and the anode strip 2 to place the anode strip 2 in the high impedance state.

On the other hand, when pixels are energized to emit light with a luminance of less than 100%, the switch 41 is placed in the state to connect the constant-current circuit 42 and the anode strip 2 to provide a selected pixel with the constant current in a shorter section than the constant current section shown in FIG. 1(*c*) to provide the selected pixel with the constant current as shown in FIG. 1(*d*). In the remaining section of the selection period, the switch 41 is placed in the state to disconnect the constant-current circuit 42 and the anode strip 2 to place the anode strip 2 in the high impedance state. The potential of a selected cathode strip 1 is at 0V (ground potential) as the selection voltage, and the potential of the non-selected cathode strips 1 is at a higher potential than the selection voltage.

When pixels are energized to emit light with a luminance of 50%, the length of the constant current section is set so that the amount of the electric charges that pass through an organic electroluminescent light emitting element in the selection period is half of the amount of the electric charges that pass through the organic electroluminescent light emitting element in the selection period when the pixels are energized to emit light with a luminance of 100%. In a case of a gray scale having any other luminance than a luminance of 50% as well, the length of the constant current section is set so that the amount of the electric charges that pass through an organic electroluminescent light emitting element in the selection period decreases by the difference in luminance in comparison with the amount of the electric charges that pass through the organic electroluminescent light emitting element in the selection period when pixels are energized to emit light with a luminance of 100%.

In order to set the selection period in the second driving method at the same length as the selection period in the first driving method, when the constant current section in the second driving method is ½ of the constant current section in the first driving method, it is sufficient that the value of the current supplied from the constant-current circuit 41 is set to be substantially doubled in comparison with the value of that in the first driving method.

In a case wherein the emission luminance in the first driving method is the same as the emission luminance in the second driving method, on the assumption that the capacitance of one column including organic electroluminescent element is $C_{colm}$; when the organic electroluminescent element are driven by the first driving method, the amount of electric charges supplied to the data electrode from the driving circuit is $Q_1$, the driving voltage in the selection period for supplying the constant current to the data electrode (wherein energization is performed over the full length of the selection period) is $V_1$, the driving current in the selection period is $I_1$, and the length of the selection period is $T_{SEL1}$; and when the organic electroluminescent elements are driven by the second driving method, the amount of electric charges supplied to the data electrode from the driving circuit is $Q_2$, the voltage between the data electrode and a scanning electrode on completion of the high impedance period is $V_2$, the driving current in the constant current period is $I_2$, and the length of the constant current period is $T_{SEL2}$; Formulas listed below are satisfied. In this case, the electric charges represented in the first term of the right side in Formula 1 are supplied by the capacitive charge, and the electric charges represented in the second term of the right side in Formula 1 are supplied by application of the constant current.

$$Q_1 = C_{colm} \cdot V_1 + I_1 \cdot T_{SEL1} \quad \text{Formula 1}$$

$$Q_2 = I_2 \cdot T_{SEL2} \quad \text{Formula 2}$$

$$I_2 \cdot T_{SEL2} - C_{colm} \cdot V_2 \approx I_1 \cdot T_{SEL1} \quad \text{Formula 3}$$

Now, the electric charge control driving method as the second driving method will be explained in more detail.

The electric charges that are supplied from the constant-current circuit 41 in the constant current section are accumulated in the capacitance of all pixels in one column, and a selected pixel allows the electric charges therein to pass therethrough according to its diode characteristics. The selected pixel is energized to emit light by the electric charges passing therethrough. The electric charges that have been accumulated in the capacitance of all pixels in one column in the high impedance section pass through the selected pixel according to the diode characteristics of the selected pixel. Thus, the selected pixel continues to emit light even in the high impedance section.

On the assumption that the potential of the anode strips 2 at the end of the selection period is $V_{REST}$, electric charges, the amount of which is determined by $V_{REST}$ and the capacitance $C_{colm}$ in one column, are expected to stay in the capacitance of the pixels in the one column. Hereinbelow, the amount of the electric charges that stay in the pixels in one column at the end of the selection period is referred to as the residual electric charge amount. The amount of electric charges that have been supplied to one column from the constant current circuit 42 in the constant current section in the selection period is referred to as the supplied electric charge amount.

Figure 10B:
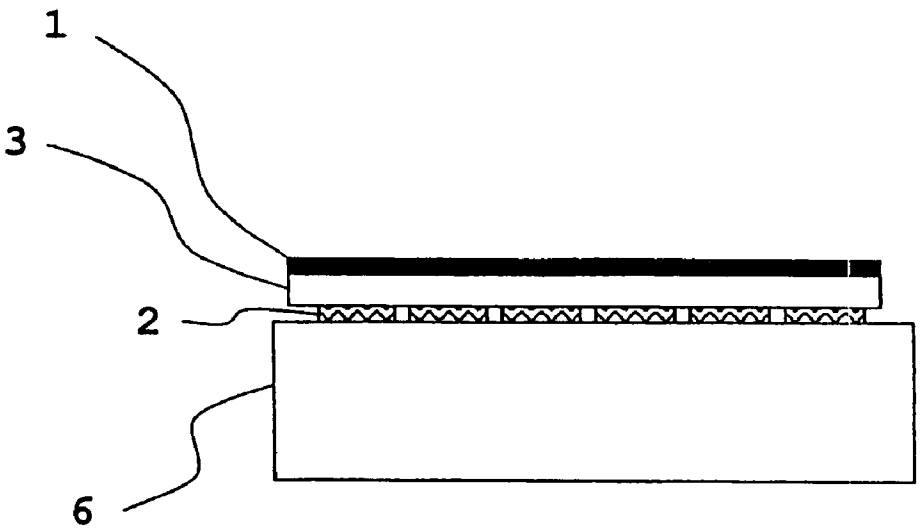
FIGS. 10(*a*) and 10(*b*) are a perspective view showing an organic electroluminescent display device and a cross-sectional view of the device, respectively.
Figure 10A:
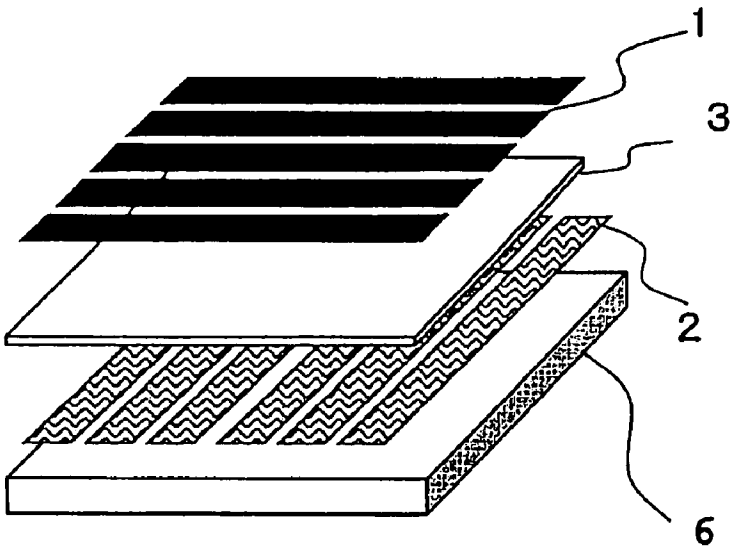
Figure 11:
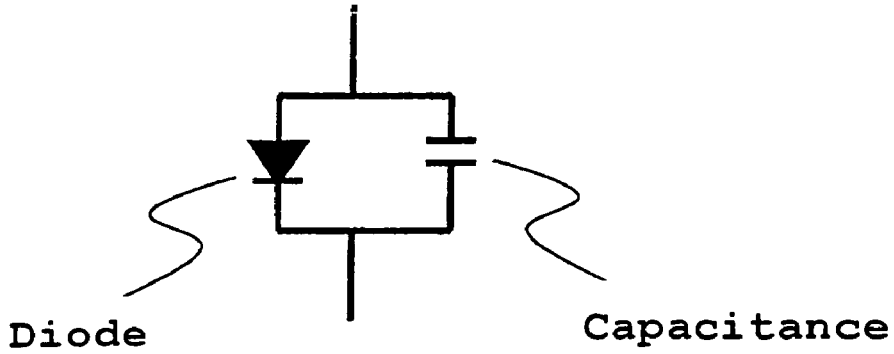
FIG. 11 is an equivalent circuit diagram of an organic electroluminescent element.
Figure 12:
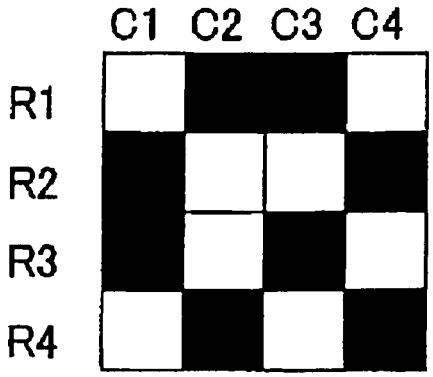
FIG. 12 is an explanatory diagram showing one example of a display pattern.
Figure 13:
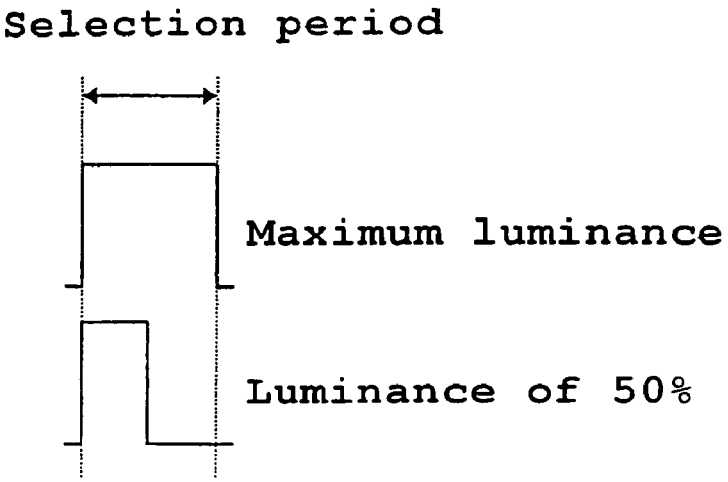
FIG. 13 is a waveform diagram showing one example of a driving waveform.
Figure 16A:
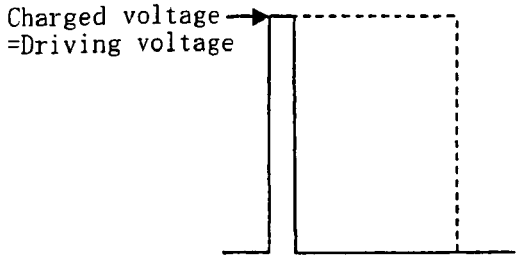
FIGS. 16(*a*) and 16(*b*) are waveform diagrams showing examples of applied voltages when a pixel is energized so as to emit light by PWM according to a conventional method.
Figure 16B:
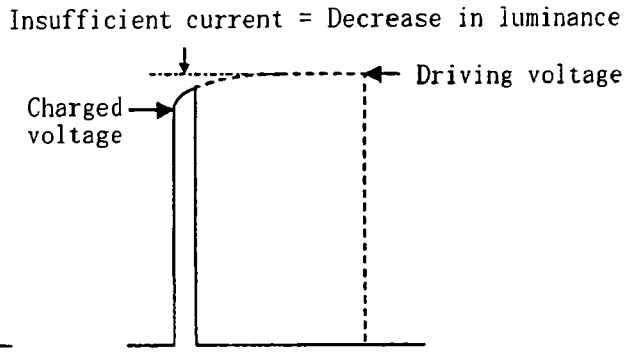

Now, the reason why chrominance non-uniformity is reduced according to the electric charge control driving method will be explained. Although the structure of an organic electroluminescent display device according to the present invention is basically similar to the structure of the conventional organic electroluminescent display device shown in FIGS. 10(*a*) and 10(*b*), it is preferable that the organic electroluminescent elements used in the organic electroluminescent display device according to the present invention have less voltage-dependence in luminous efficiency to a passing current (emission luminance/current density).

Figure 4:
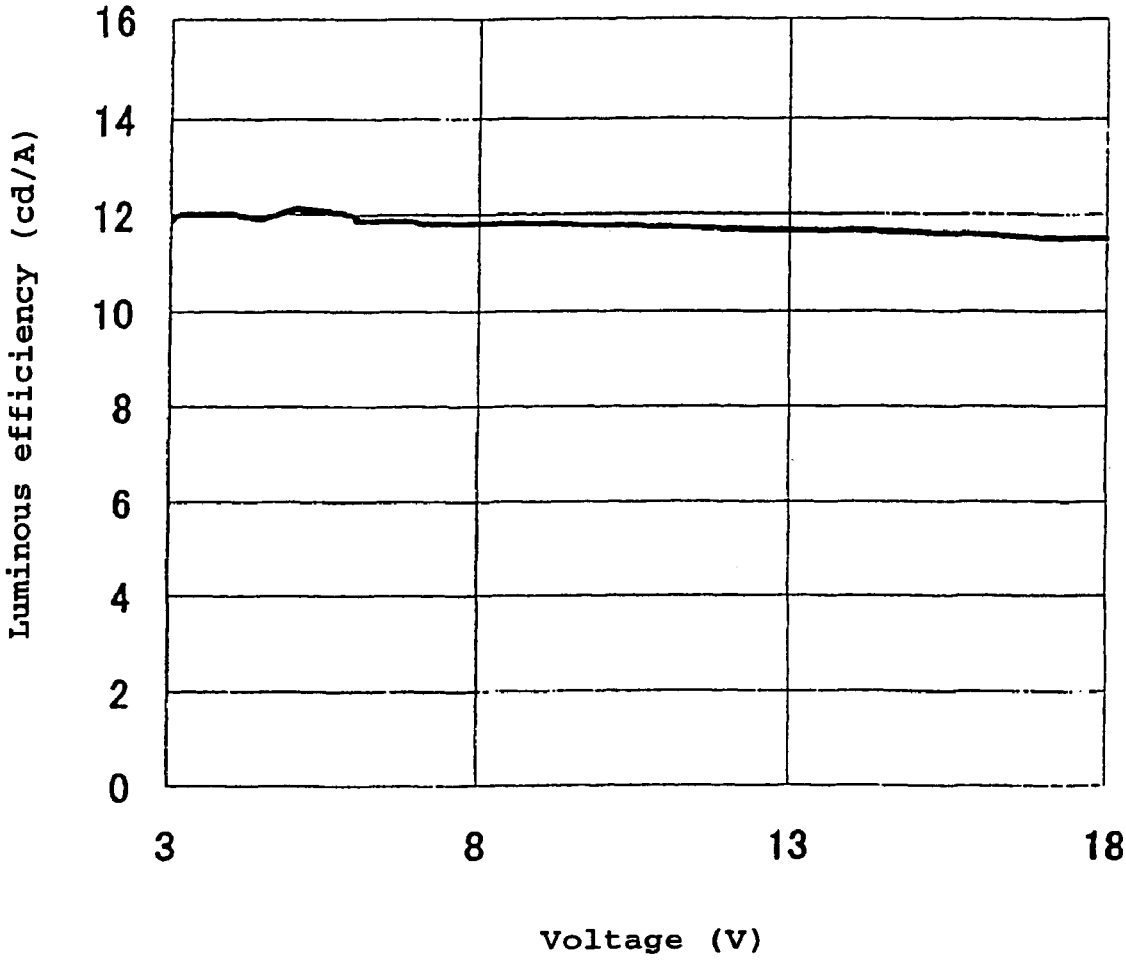
FIG. 4 is an explanatory diagram showing an example of the characteristics of an organic electroluminescent element having a small voltage-dependency in luminous efficiency.
Figure 5:
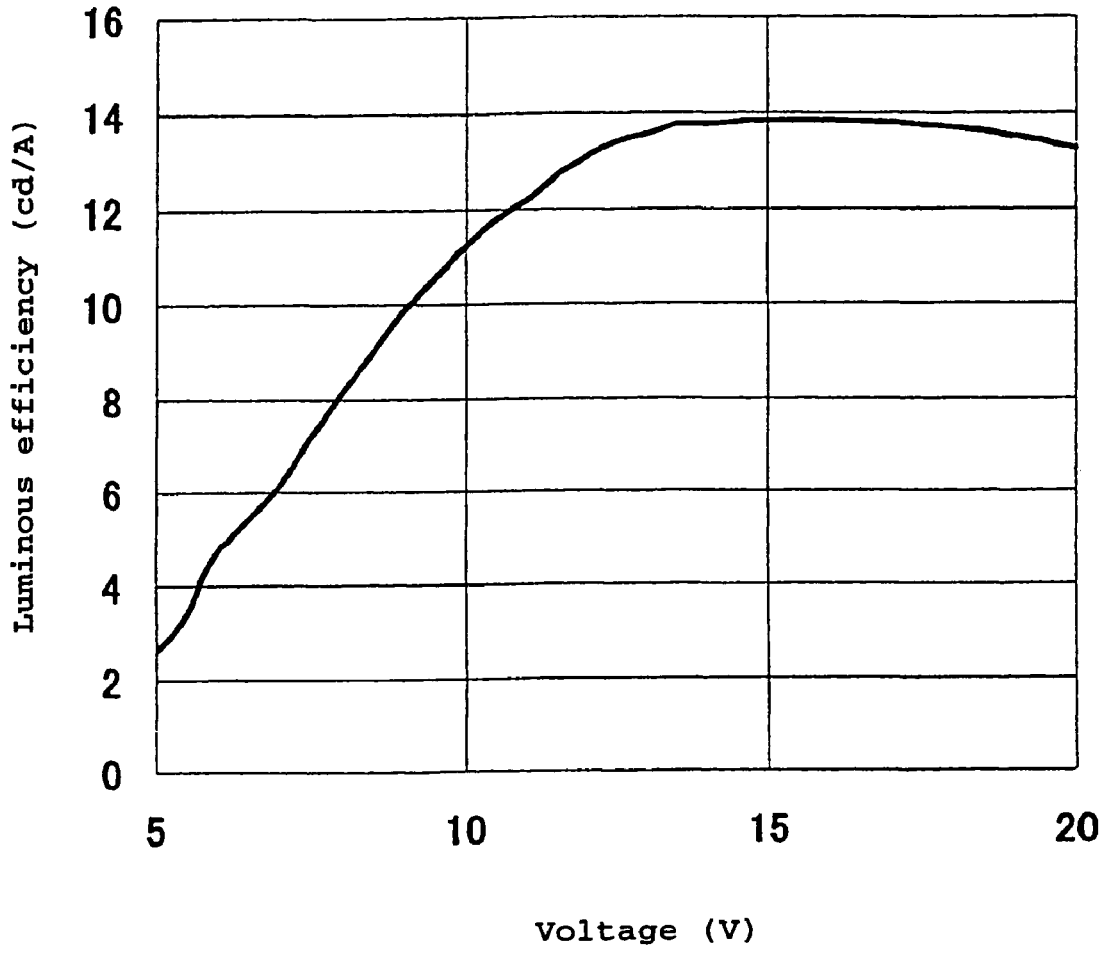
FIG. 5 is an explanatory diagram showing an example of the characteristics of an organic electroluminescent element using copper phthalocyanine.

When the hole injection layer of the organic electroluminescent elements contains an organic polymeric material, the organic electroluminescent elements can have a substantially constant luminescent efficiency irrespective of a voltage applied to the pixels. FIG. 4 shows an example of the characteristics of an organic electroluminescent element having less voltage-dependence in luminous efficiency. FIG. 5 shows an example of the characteristics of an organic electroluminescent element having a hole injection layer made of copper phthalocyanine. In each of FIG. 4 and FIG. 5, the horizontal axis designates a voltage applied to the pixels, and the vertical axis designates luminous efficiency. In the characteristics shown in FIG. 4, the degree of variations ((the maximum value−the minimum value)/the minimum value) in the luminous efficiency is less than 10% in a voltage range of 15 V from 3 to 18 V. In general, the range of from 3 to 18 V may be regarded as containing the range of voltages, which are applied across the anode and the cathode of an organic electroluminescence panel in the selection period (except the rising time of a voltage applied to pixels in the selection period, i.e., the period that is required until the voltage across the anode and the cathode of the organic electroluminescent panel has attained a substantially stable state).

As shown in FIGS. 1(*c*) and (*d*), the voltage applied to pixels is not constant in the constant current section in the case of the electric charge control driving method. However, the luminous efficiency becomes substantially constant irrespective of applied voltages by using organic electroluminescent elements having the characteristics shown as an example in FIG. 4. That is to say, when the same amount of current flows in the selection period, the same amount of light emission can be obtained in the selection period irrespective of applied voltages. In other words, a selected pixel emits an amount of light emission according to the amount of electric charges that have passed through the organic electroluminescent element in the selection period. Hereinbelow, the amount of electric charges that pass the organic electroluminescent element is referred to as an element-passing electric charge amount. The element-passing electric charge amount means (the amount of supplied electric charges−the amount of residual electric charges).

When the amount of element-passing electric charges is constant in respective gray scale levels, the amount of light emission in the respective gray scale levels in the selection period becomes constant. By setting the amount of element-passing electric charges according to a difference in the gray scale levels, it is possible to obtain a desired grayshade. The amount of supplied electric charges can be easily set since the amount of supplied electric charges is determined by the value of an output current from the constant-current circuit 42 and the length of the constant current section. It is difficult to control the amount of residual electric charges. However, if it is possible to estimate $V_{REST}$, it is possible to substantially accurately estimate the amount of residual electric charges since it is easy to figure out the capacitance $C_{colm}$ in one column.

The amount of element-passing electric charges in the respective gray scale levels may be determined based on a required luminance for the respective gray scale levels. When the amount of element-passing electric charges and the amount of residual electric charges are determined for the respective gray scale levels, it is possible to make the amount of light emission constant in the respective gray scale levels by setting the amount of supplied electric charges at the value that is obtained by adding the amount of residual electric charges to the amount of element-passing electric charges, i.e., summing the amount of residual electric charges and the amount of element-passing electric charges.

In other words, the electric charge control driving method is a driving method, wherein a certain amount of electric charges (specifically, the sum of the amount of element-passing electric charges and the amount of residual electric charges) are supplied to a column electrode in a prescribed section in the selection period, and the output to the data electrode from the driving circuit is placed in the high impedance state in the remaining section in the selection period. In order to establish that sort of driving, a constant current section having a shorter length than the selection period may be set so as to be contained in the selection period, and a constant current is supplied to the column electrode from the constant-current circuit in the constant current section for instance. After that, the column electrode is disconnected from the constant-current circuit and is placed in the high impedance state without being connected to a constant voltage in the remaining section in the selection period. By using the electric charge control driving method, it is possible to determine the amount of element-passing electric amount according to the required luminance in respective gray scale levels. Thus, it is possible to reduce chrominance non-uniformity. As a result, it is also possible to reduce horizontal cross-talk. The constant current section corresponding to an amount of supplied electric charges, i.e., the driving pulse width, may be represented by Formula 7:

$$\text{Driving Pulse Width} = C_1 \cdot \text{required luminance of gray scale level} + C_2 \qquad \text{Formula 7}$$

In Formula 7, $C_1$ is a constant, and $C_2$ is equal to an additional part (added part) corresponding to the amount of residual electric charges. $C_2$ is a value dependent on temperature and may vary depending on the ambient temperature of an organic electroluminescent element. Specifically, when the ambient temperature of an organic electroluminescent element is high, $C_2$ may be decreased. When the ambient temperature of the organic electroluminescent element is low, $C_2$ may be increased.

Figure 6:
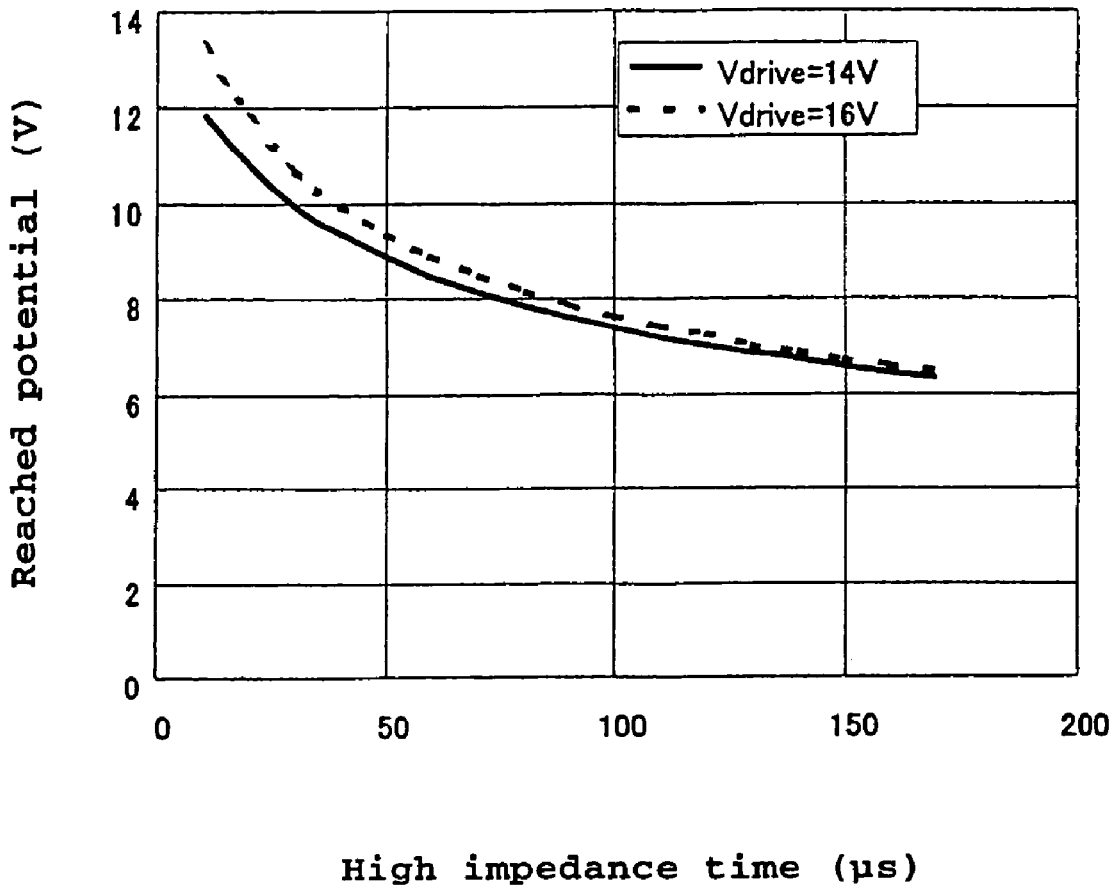
FIG. 6 is an explanatory diagram showing measurement results for the relationship between a reached potential and the length of a high impedance period.

In some cases, the potential $V_{drive}$ of the anode strips 2 at the start of the high impedance section varies because of, e.g., variations in the characteristics of organic electroluminescent elements. However, it is possible to obtain display on a display screen in a uniform fashion irrespective of variations in the potential $V_{drive}$ by setting the high impedance section so as to have a sufficiently long length. FIG. 6 is an explanatory diagram showing measurement results for the relationship between a reached voltage and the length of a high impedance section (high impedance time) in a case wherein an organic electroluminescent display device using an organic electroluminescent element having the characteristics shown in FIG. 4 was driven with a duty of 1/64 by the electric charge control driving. The reached voltage means the potential of the anode strips 2. The solid line in this figure designates measurement results that were obtained when the potential $V_{drive}$ of the anode strips 2 at the end of the constant current section, i.e., the start of the high impedance section, was 14 V. The dotted line designates measurement results that were obtained when the potential $V_{drive}$ was 16 V.

The reached voltages gradually lower with lapse of the high impedance time. Even in a case wherein $V_{drive}$ at the end of the constant current section varies, the difference between reached voltages is made quite smaller when the high impedance time as the length of a high impedance section is about 70 μs. When the high impedance time is beyond about 70 μs, the difference is made further smaller.

Figure 7:
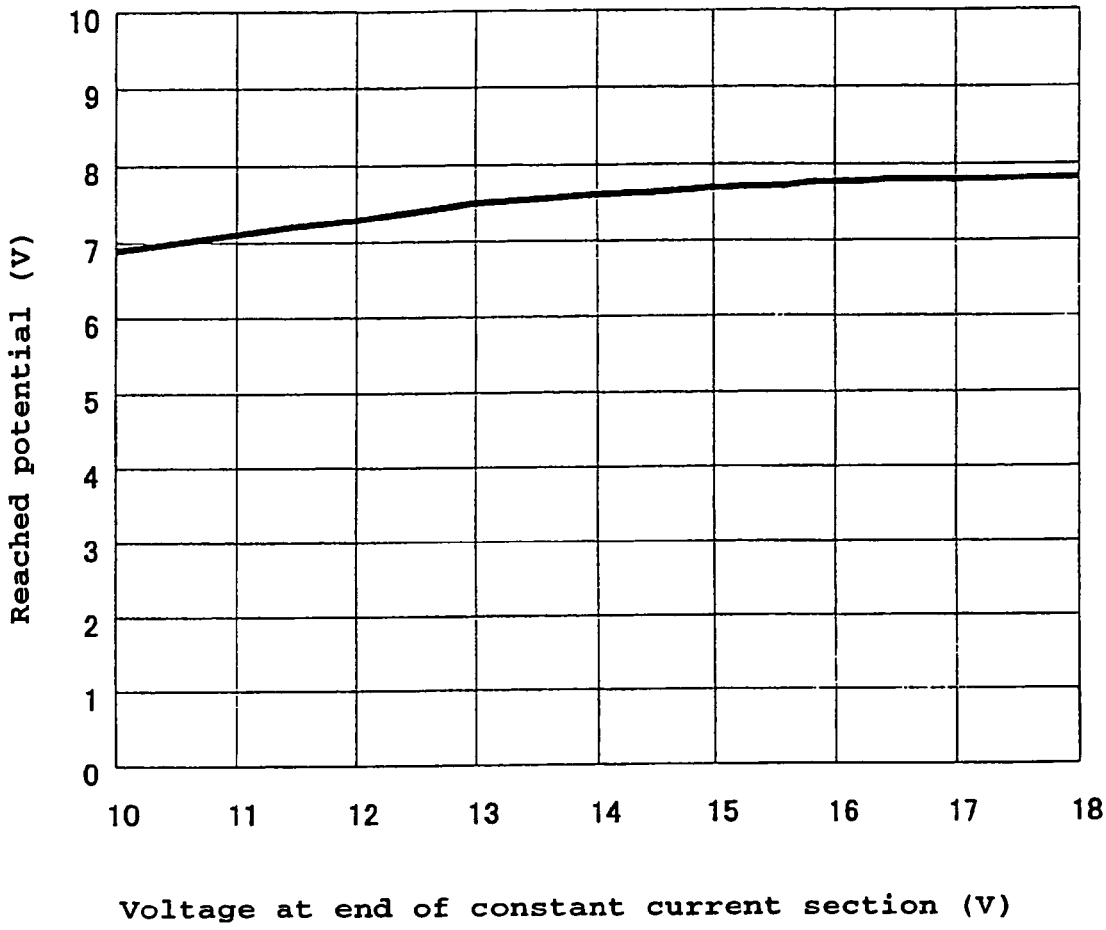
FIG. 7 is an explanatory diagram showing measurement results for the relationship between a reached potential and a voltage at anode strips at the end of a constant current section.

FIG. 7 is an explanatory diagram showing measurement results for the relationship between the potential of anode strips 2 and a reached voltage at the end of a constant current section in a case wherein an organic electroluminescent panel using an organic electroluminescent element having the characteristic shown in FIG. 4 was driven with a duty of 1/64 by the electric charge control driving, and the high impedance time was set at 94 μs. As shown in FIG. 7, the reached voltages at the end of the high impedance time of 94 μs were almost constant irrespective of the voltages at the anode strips 2 at the end of the constant current section.

Based on the measurement results shown in FIG. 6, reached potentials may be regarded as being substantially constant irrespective of variations in $V_{drive}$ as long as the high impedance time is beyond about 70 μs. For example, a specific reached potential may be estimated as being 7V based on the measurement results shown in FIG. 6. The amount of the residual electric charges can be calculated according to (reached potential×capacitance in one column). In the case of an organic electroluminescent display device using an organic electroluminescent element having the characteristics shown in FIG. 4, it is possible to estimate the amount of residual electric charges unambiguously irrespective of gray scale levels, and accordingly it is possible to determine $C_2$ in Formula 7 unambiguously. Thus, it is possible to determine the amount of supply electric charges, i.e., the drive pulse width that is appropriate to the required luminescence for the respective gray scale levels. By setting the drive pulse width appropriately, the amount of element-passing electric charges can have a value appropriate to each of the gray scale levels, suppressing chrominance non-uniformity in each of the gray scale levels.

Now, the driving parameters that can effectively utilize the driving method according to the present invention will be described, referring to FIG. 8. In the case of a small duty, almost neither chrominance non-uniformity nor horizontal cross-talk is caused even in a conventional method since the selection period can be lengthened. Specifically, in the case of a duty ratio of less than 1/32, the electric charge control driving is effective (see the straight line showing "Range wherein invention can offer its advantages in sufficient fashion" in FIG. 8). Since it is impossible to determine the high impedance time so as to cover the entire range of the selection period, there are limitations to the high impedance time according to a utilized duty (see to the curved line "Maximum value of high impedance time" in FIG. 8). Additionally, it is preferable that a section occupying at least about 20% of the selection period is allotted to the constant current section in the case of a frame frequency of 60 Hz for instant. From this viewpoint, there are limitations to the high impedance time (see to the curved line "Minimum value of high impedance time" in FIG. 8).

Figure 8:
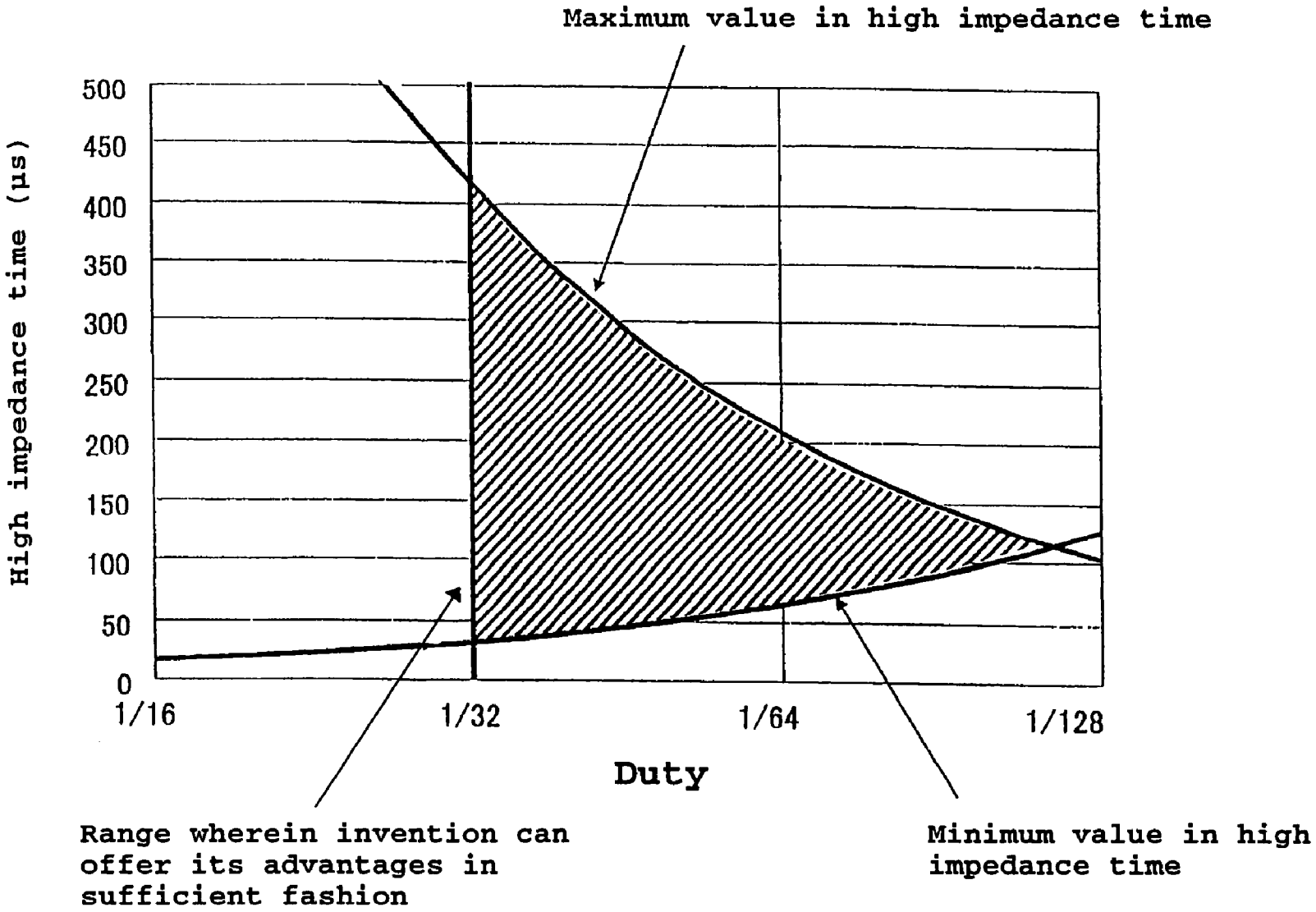
FIG. 8 is an explanatory diagram explaining a range wherein the electric charge control driving is applicable.

In sum, the driving method according to the present invention can be effectively applied in the hatched region in FIG. 8. In other words, this region ranges from a duty ratio of less than 1/3 to a duty ratio of greater than 1/128 (an area on the left side with respect to the duty ratio of 1/128 in FIG. 8) and from a high impedance time occupying a length of greater than 0% of the selection period to a high impedance time occupying a length of not greater than 80% of the selection period. In practice, it is preferable that the high impedance time is not shorter than about (1/duty ratio) us and occupies a length of 80% or less of the selection period as stated earlier. When the frame frequency is 120 Hz or lower, the high impedance time may be set so as to occupy ½ of the selection period as long as the duty ratio is greater than 1/64. When the frame frequency is 70 Hz or lower, the high impedance time may be set so as to occupy a length of ½ of the selection period as long as the duty ratio is 1/84 or more.

When an organic electroluminescent display device, which uses organic electroluminescent elements having a small voltage-dependency in luminous efficiency, is driven by passive matrix addressing, and when the high impedance section following the constant current section is set in a selection period as stated earlier, it is possible to reduce chrominance non-uniformity and horizontal cross-talk in a low gray scale level in the case of, in particular, PWM. In other words, it is possible to improve display quality.

Although the degree of variations in luminous efficiencies is 10% or less in the range of voltages applicable to a pixel in the selection period as shown in FIG. 4, it is conceivable that the electric charge control driving method according to the present invention can be practically utilized as long as the degree of variations is about 15% in that range.

For example, even when the output voltage from the driving circuit is in a range of from 3 to 18 V at room temperature, there is a possibility that the output voltage can be beyond 18 V in a low ambient temperature, such as 0° C. It is supposed that even when the output voltage is beyond 18 V, the electric charge control driving method can be practically performed since the degree of variations in the luminance efficiency falls within a range of 15%.

On the other hand, in accordance with the second driving method, it is possible to reduce power consumption since capacitive charge is not performed. This advantage becomes noticeable, in particular, when the number of pixels to turn on is small, i.e., when the ratio of pixels to turn on is low.

TYPICAL EXAMPLE 1

Now, a first typical example of the present invention will be described. In accordance with this typical example, when the ambient temperature of an organic electroluminescent panel is relatively low, the first driving method is performed. When the ambient temperature of the organic electroluminescent panel is relatively high, the electric charge control driving method as the second driving method is performed. Being relatively low means that it is lower than 0° C. for instance. Being relatively high means that it is not lower than 0° C. for instance.

In the case of performing the second driving method, the driving current and the driving voltage, which are supplied from the data driver 4, increase in comparison with the case of performing the first driving method. For example, in order to obtain substantially the same luminance as the case of performing the first driving method, when the constant current section is set so as to occupy a half length of the selection period, the driving current is required to be doubled in comparison with the case of performing the first driving method. This requires that the driving voltage be a voltage necessary to double the driving current. As a result, the driving voltage increases by, e.g., 3V in comparison with the case of performing the first driving method.

Organic electroluminescent elements need a higher voltage in order to keep the luminance substantially constant as the ambient temperature becomes lower. In the case of performing the first driving method, the voltage required at −40° C. is higher than the voltage required at 20° C. by about 5V for instance. The voltage required at −40° C. is higher than the voltage required at 0° C. by about 3V for instance. As stated earlier, when the constant current section is set so as to occupy a half length of the selection period, the driving voltage under the second driving method increases by about 3 V in order to substantially the same luminance as the case of performing the first driving method.

In other words, the value of the driving voltage required at −40° C. in the case of performing the first driving method is substantially equal to the value of the driving voltage required at 0° C. in the case of performing the second driving method. This means that when the data driver 4 and the power source can drive an organic electroluminescent element in accordance with the first driving method, the data driver and the power source can supply a voltage required to drive the organic electroluminescent element at 0° C. in accordance with the second driving method.

In this typical example, the organic electroluminescent panel has an ambient temperature sensing means, such as a temperature sensor, provided in the vicinity thereof. When the ambient temperature sensing means detects that the ambient temperature is lower than 0° C., the data driver 4 is controlled in accordance with the first driving method. When the ambient temperature sensing means detects that the ambient temperature is not lower than 0° C., the data driver 4 is controlled in accordance with the second driving method. By switching between the driving methods, it is possible to enjoy the advantage offered by the electric control driving method stated earlier in a range of not lower than 0° C. without adapting the data driver 4 and the power source for high voltage application, i.e., without increasing the cost of the data driver 4 and the power source.

When an organic electroluminescent display device is used as a vehicle-borne display, the device is normally operated in a relatively high temperature region, such as a range beyond 0° C. Although there is a possibility that horizontal cross-talk or chrominance non-uniformity is visually recognized in the case of performing the first driving method, the first driving method is performed for temperatures lower than 0° C. in accordance with this typical example. Although it is preferable that an organic electroluminescent display device is operable even in a relatively low temperature region, such as temperatures lower than 0° C., it is impossible to obtain high display quality in that region. From this viewpoint, the organic electroluminescent display device according to this typical example is appropriate to be used as a vehicle-borne display.

Temperatures lower than 0° C. as the low temperature range are referred to by way of one example. Another temperature, such as a temperature contained in a range of from −10° C. to +10° C., may be used as the boundary value between a low temperature and a high temperature. The boundary value is set so that the first driving method is performed at a temperature of not higher than the boundary value, and that when the second driving method is performed at a temperature beyond the boundary value, the driving voltage becomes lower than a desired value over the entire operable ambient temperature range. The desired value means a value of not higher than the maximum voltage that the driving circuit can be deal with, for instance.

Although the boundary value as the driving method switching temperature may be unambiguously set, the switching temperature from the first driving method to the second driving method and the switching temperature from the second driving method to the first driving method may be different from each other. For example, the switching temperature from the second driving method to the first driving method, i.e., the boundary value in the case of a change from a high temperature to a low temperature is set at 0° C., and the switching temperature from the first driving method to the second driving method, i.e., the boundary value in the case of a change from a low temperature to a high temperature is set at +5° C. In the case of unambiguously setting the boundary value, when the ambient temperature rises or drops in the vicinity of the boundary value, the driving method are frequently switched. However, it is possible to prevent the driving method from being frequently switched by setting different boundary values.

Although the reset driving method, the precharge driving method or the current boost driving method can be utilized as the first driving method, the first driving method is not limited to these driving methods. The first driving method may utilize another driving method, which supplies a constant current to data electrodes in a selection period after performing the capacitance charge, and then applies a constant voltage to the data electrodes to turn off the pixels. In the first driving method, the capacitance charge may be performed before the selection period or at the initial stage of the selection period.

TYPICAL EXAMPLE 2

In the case of using an organic electroluminescent display device as a vehicle-borne display, the organic electroluminescent display device is provided with a function to switch the luminance of the organic electroluminescent panel from a high luminescent state as a normal state to a dimming state having a low luminescent state when the surroundings become dark. For example, the luminance in the high luminance time is 50 to 100% of the maximum luminescence of the organic electroluminescent panel (hereinbelow, referred to as the rated luminance), and the luminance in the dimming time is not higher than 50% of the rated luminance of the organic electroluminescent panel. Whether luminescence is placed in the high luminance state or the dimming state is determined based on a signal, which is inputted to the organic electroluminescent display device from outside to the device. Such a signal may be automatically outputted by a driver operating a car switch, such as a switch for turning on the headlights, or is automatically outputted from a controller mounted on the vehicle according to the brightness surrounding the vehicle, for instance. Light emission at the rated luminance will be called the rated light emission.

In this typical example, the organic electroluminescent element is driven by the first driving method in the normal time as the high luminescent state, and the organic electroluminescent element is driven by the second driving method in the dimming time. The horizontal cross-talk and so on, which can be caused when the organic electroluminescent element is driven by the first driving method, can be difficult to be visually recognized in the normal time since the surroundings are bright. In other words, the use of the first driving method causes no problem in practice in the normal time. However, the horizontal cross-talk and so on can be visually recognized easily in the dimming time since the surroundings are dark. From this viewpoint, the second driving method is performed in the dimming time.

In a case where the luminance in the dimming time with the electric charge control driving method as the second driving method performed is not higher than 50% of the rated luminance of the organic electroluminescent panel, when the constant current section under the control of the electric charge control driving method occupies a half length of the selection period for instance, the current that is fed to an organic electroluminescent element in the dimming time lowers to a value, which is not higher than the value of the current that is fed in the rated light emission by the first driving method.

FIGS. 9(*a*) to 9(*d*) are schematic views explaining the driving method according to this typical example. FIGS. 9(*a*) and (*b*) show examples of the driving waveform according to the first driving method, which are used in the normal time. FIGS. 9(*c*) and (*d*) show examples of the driving waveform according to the second driving method, which are used in the dimming time. FIG. 9(*a*) shows an example of the driving waveform according to the first driving method. FIG. 9(*b*) shows an example of the driving waveform according to PWM in the first driving method.

In order to obtain a grayshade of 100% in the normal time, a pixel to emit light is supplied with a current in the entire range of the selection period as shown in FIG. 9(*a*). In order to set the luminance at a grayshade of below 100% in the normal time, the driving by PWM is used as shown as an example in FIG. 9(*b*).

FIG. 9(*c*) shows the driving waveform, which is used to obtain a grayshade of 100% in the dimming time, wherein the constant current is supplied between a shorter section $T_{SEL2}$ than the selection period $T_{SEL1}$, and the remaining section in the selection period is in the high impedance state. FIG. 9(*d*) shows the driving waveform to obtain a grayshade of below 100% in the dimming time, wherein the current is set at the same value as the grayshade of 100% shown in FIG. 9(*c*), and the driving by PWM is used with the constant current section being shorter than the constant current section shown in FIG. 9(*c*).

In the dimming time, the constant current in the constant current section is set at a smaller value according to a decrease in luminance. When the dimming ratio, i.e., (the luminance in the dimming state)/(the luminance in the normal state) in a gray scale of 100% is defined as $R_{DIM}$, the following Formula 6 is satisfied. The amount of the electric charges $Q_1$ that is supplied to a column electrode from the driving circuit when being driven by the first driving method, and the amount of the electric charges $Q_2$ that is supplied to a column electrode from the driving circuit when being driven by the second driving method are represented by Formulas 4 and 5, which are the same as Formulas 1 and 2, respectively. The electric charges represented in the first term of the right side in Formula 4 are supplied by the capacitive charge, and the electric charges represented in the second term of the right side in Formula 4 are supplied by application of the constant current.

$$Q_1=C_{colm}\cdot V_1+I_1\cdot T_{SEL1} \quad \text{Formula 4}$$

$$Q_2=I_2\cdot T_{SEL2} \quad \text{Formula 5}$$

$$R_{DIM}=(I_2\cdot T_{SEL2}-C_{colm}\cdot V_2)/(I_1\cdot T_{SEL1}) \quad \text{Formula 6}$$

For example, in the case wherein the luminance in the dimming time is set at 20% of the luminance in the normal time under a gray scale of 100%, when $C_{colm}V_2$ is neglected, it is sufficient that the value of the current is set at 40% of that in the normal time as long as $T_{SEL2}$ is 50% of $T_{SEL1}$. When the driving current is lowered in the dimming time as shown in FIG. 9(*c*), the driving voltage is also lowered. However, this does not mean that when the driving current is set at ½ for instance, the driving voltage always becomes ½.

In this typical example, the light-emission luminance, at which the first driving method and the second driving method are switched, is set at 50% of the rated luminance. However, the light-emission luminance at the time of switching between the driving methods is not limited to this value. For example, the light-emission luminance at the time of switching between the driving methods may be set at any value in a range of from 40% to 60% of the rated luminance.

When an organic electroluminescent element is driven by the first driving method, particularly, at a low gray scale, horizontal cross-talk or chrominance non-uniformity is caused, degrading the display quality. The display quality can be visually recognized in an easy fashion in the dimming time since the surroundings are dark. This will be explained.

The case wherein the luminance in the dimming time is set at 1/10 of the luminance in the normal state will be taken for example. Suppose that the first driving method is used even in the dimming time. Although it is enough that the value of the current flowing a selected pixel is set at 1/10 in order to lower the luminance to 1/10, the organic electroluminescent element has such a characteristics that the flowing current is not proportional to the value of the applied voltage. For example, the value of the current is lowered to 1/10, the value of the applied voltage is lowered to about ⅔. In an organic electroluminescent element, the non-uniformity in an applied voltage caused by, e.g., the non-uniformity in the film thickness of the organic thin film is lowered to about ⅔. Chrominance non-uniformity is substantially represented by Formula 8.

Chrominance non-uniformity=(non-uniformity in voltage×capacitance of one column)/(electric charges flowing a selected pixel in the selection period+voltage×capacitance of one column) Formula 8

An organic electroluminescent element has such a characteristics that (electric charges flowing through a selected pixel in the selection period):(voltage×capacitance of one column) is about 5:1 in the normal time. In the dimming time, the denominator of the right side of Formula 8 is lowered to about ⅕ since the electric charges flowing through a selected pixel in the selection period is lowered to 1/10, and since the voltage is lowered to ⅔. On the other hand, the fraction of a right side of Formula 8 is lowered to about ⅔ since the non-uniformity in voltage is lowered to about ⅔. Accordingly, the chrominance non-uniformity in the dimming time is about 3.3 times higher than that in the normal time because of (⅔)/(⅕). In other words, when an organic electroluminescent panel, which causes no chrominance non-uniformity in the normal time even if being driven by the first driving method, is driven by the first driving method in the case of a lower luminance, the organic electroluminescent panel displays an image wherein chrominance non-uniformity is visually recognized.

In this typical example, the electric charge control driving, which can prevent horizontal cross-talk or chrominance non-uniformity from being caused, is performed in the dimming time. Thus, it is possible to prevent the display quality at a low luminance from degrading. As shown in FIGS. 9(*c*) and 9(*d*), the driving current may be small in the dimming time since the luminance is lowered. This means that the data driver 4 and the power source do not need to be a type for high voltage application. In other words, it is possible not only to prevent the display quality from degrading but also to prevent the costs of the data driver 4 and the power source from increasing.

Although the reset driving method, the precharge driving method or the current boost driving method can be utilized as the first driving method, the first driving method is not limited to these driving methods. The first driving method may utilize another driving method, which supplies a constant current to data electrodes in a selection period after performing the capacitance charge, and then applies a constant voltage to the data electrodes to turn off the pixels. In the first driving method, the capacitance charge may be performed before the selection period or at the initial stage of the selection period.

TYPICAL EXAMPLE 3

In the first typical example, when the ambient temperature of an organic electroluminescent panel is relatively low, the first driving method is utilized, and when the ambient temperature is relatively high, the second driving method is utilized. In the second typical example, the first driving method is utilized in the normal time, and the second driving method is utilized in the dimming time. The first typical example and the second typical example may be combined.

Specifically, when the ambient temperature of an organic electroluminescent panel is relatively high, the electric charge control driving method as the second driving method is utilized. Additionally, when dimming is performed in such a state that the ambient temperature of the organic electroluminescent panel is relatively low, the second driving method is also utilized. When the ambient temperature of the organic electroluminescent panel is relatively low, and when dimming is not performed, the first driving method is utilized.

Specifically, the organic electroluminescent panel has an ambient temperature sensing means, such as a temperature sensor, provided in the vicinity thereof, and a detection signal from the ambient temperature sensor is input into the driving circuit. Additionally, a signal indicating whether to perform dimming, such as a signal from a car switch, is input into the driving circuit. When the detection signal from the ambient temperature sensor shows that the ambient temperature is relatively high, or when it is shown that the ambient temperature is not lower than 0° C., the driving circuit commands the data driver 4 to drive data electrodes by the second driving method.

When the detection signal from the ambient temperature sensing means shows that the ambient temperature is relatively low, or when it is shown that the ambient temperature is lower than 0° C., and when a signal indicating whether to perform dimming indicates that dimming should be performed, the driving circuit commands the data driver to drive data electrodes by the second driving method. When the detection signal from the ambient temperature sensor shows that the ambient temperature is lower than 0° C., and when the signal indicating whether to perform dimming indicates that dimming should not be performed, the driving circuit commands the data driver to drive data electrodes by the first driving method.

It is an example that temperatures lower than 0° C. are determined to be relatively low. Another temperature, such as a temperature contained in a range of from −10° C. to +10° C., may be used as the boundary value. The light emission luminance, at which the driving methods should be switched at a low temperature as in the second typical example, may be set at, i.e., 40% to 60% with respect to the rated luminance as 100%.

The data driver 4 drives data electrodes by any one of the first driving method and the second driving method in accordance with a command stated earlier.

In this typical example, when the ambient temperature of an organic electroluminescent panel is relatively high, the electric charge control driving method is utilized even in the normal time as in the first typical example and as not in the second typical example. When the organic electroluminescent panel is used as a vehicle-borne display, it is possible to constantly enjoy the merits offered by the electric charge control driving stated earlier in a normal temperature region (relatively high temperature region).

Although the reset driving method, the precharge driving method or the current boost driving method can be utilized as the first driving method, the first driving method is not limited to these driving methods. The first driving method may utilize another driving method, which supplies a constant current to data electrodes in a selection period after performing the capacitance charge, and then applies a constant voltage to the data electrodes to turn off the pixels. In the first driving method, the capacitance charge may be performed before the selection period or at the initial stage of the selection period.

Now, examples of the driving method according to the present invention will be shown.

EXAMPLE 1

Organic electroluminescent panels for passive matrix addressing were provided on respective glass substrates. Each of the panels was fabricated as follows. An ITO film was deposited on the glass substrate so as to have a film thickness of 200 nm, and the deposited film was etched to form anode strips 2. A film of chrome (Cr) and a film of aluminum (Al) were deposited so as to have a layered structure having a film thickness of 300 nm, and the deposited layered structure was etched to form circuitous wiring in the organic electroluminescent panel. On the etched structure, photosensitive polyimide was applied as an insulating film, and the applied film was exposed and developed to form openings working as light emitting portions of respective pixels. On the structure thus layered, a thin film was deposited to form a hole injection layer having a film thickness of 30 nm as an organic electroluminescent layer by a wet application method using an organic solvent containing PTPDEK as an organic polymeric material. PTPDEK is manufactured by Chemipro Kasei Kaisha, Ltd. for example. The weight-average molecular weight of PTPDEK is 1,000 or more. The organic solvent needs to contain 50 wt % or more of PTPDEK.

Additionally, on the structure thus fabricated, organic electroluminescent layers were layered by vapor deposition. Specifically, for formation of a hole transport layer, a film of α-NPD was deposited so as to have a film thickness of 100 nm. Next, for formation of a light emitting layer made of an organic luminescent material, a film of Alq as a host compound and a film of Coumarin 6 as a fluorescent pigment of a guest compound were simultaneously formed so as to have a film thickness of 30 nm by vapor deposition. On the light emitting layer, a film of Alq was formed so as to have a film thickness of 30 nm for formation of an electron transport layer by vapor deposition, and a film of LiF was additionally formed so as to have a film thickness of 0.5 nm as a cathode interface layer. Finally, a film of Al was deposited to form scanning electrodes having a film thickness of 100 nm as the cathode strips 1, and the scanning electrodes were connected to cathode circuitous wiring.

Next, in order to protect the organic electroluminescent layers from moisture, an additional glass substrate was provided so as to confront the glass substrate stated earlier, both substrates were bonded by a peripheral seal, and a dry nitrogen gas was sealed in the portion encapsulated by the glass substrates and the peripheral seal.

The organic electroluminescent panels thus fabricated were connected to driving circuits to make an organic electroluminescent display devices. The pixel arrangement was 96 (columns)×64 (rows), and a pixel pitch was 0.35 mm×0.35 mm. Each of the organic electroluminescent panel was energized at a frame frequency of 86 Hz and with a duty of 1/64 by the electric charge driving. The number of the gray scale levels was set at 16 (including a black level). An ML9361 product manufactured by Oki Electric Co., Ltd. was used as the data driver 4 in each of the panels.

As shown in Table 1, each of the organic electroluminescent panel was driven by the electric charge control driving method as the second driving method in an ambient temperature range of from 0° C. to 90° C. (not lower than 0° C. and not higher than 90° C.) and by the reset driving method as the first driving method in an ambient temperature range of from −40° C. to 0° C. (not lower than −40° C. and lower than 0° C.). The length of the selection period (the selection time) was 182 μs, while the idle period was set at a length of 6 μs. Additionally, a gray shade having 16 gray scale levels (including a black level) was performed by PWN.

As shown in Table 1, the driving current was 0.3 mA per pixel in the first driving method and 0.6 mA per pixel in the second driving method. Under the second driving method, the current application section at the maximum gray scale level in the constant current section at the maximum luminance was set at a length of 98 μs, and the high impedance time as the length of the high impedance section at the maximum gray scale level was 78 μs, i.e., 43% of the selection time.

The electric charge driving was performed under the conditions stated above. The supply voltage of the drive circuits was 22 V or lower. In the temperature range of from 0° C. to 90° C., neither chrominance non-uniformity nor cross-talk was visually recognized. In the temperature range of from −40° C. to 0° C., cross-talk was visually recognized. When using a panel including an organic electroluminescent element having an uneven distribution in the driving voltage (non-uniformity in voltage), chrominance non-uniformity was visually recognized at a low gray scale in the latter temperature range. It was verified that the display quality was not degraded in a normal temperature region contained in the temperature range of from 0° C. to 90° C. without increasing the supply voltage of the driving circuit to a higher voltage than 25 V. In other words, it was possible to verify the advantages offered by the first typical example. The phrase "having an unevenness of place distribution in the driving voltage" means that the pixels made of an organic electroluminescent element have variations in current-voltage characteristics. The driving voltage of each pixel can be observed by measuring the voltage waveform of the data electrode (segment). Driving circuits, the supply voltage of which is higher than 25 V, are more expensive than driving circuits, the supply voltage of which is not higher than 25 V, in most cases.

TABLE 1

| | Example 1 | |
|---|---|---|
| Temperature range | 0° C. to 90° C. | −40° C. to 0° C. |
| Driving method | Electric charge control driving method | Reset driving method |
| Gray scale method | PWM | PWM |
| Driving current (mA/pixel) | 0.6 | 0.3 |
| Supply voltage | 14 V (90° C.) to 22 V (0° C.) | 18 V (−1° C.) to 22 V (−40° C.) |
| Shortest high impedance time (μs) | 78 | 0 |
| Ratio of shortest high impedance time | 43% | 0% |
| Current application time at maximum gray scale level (μs) | 98 | 176 |
| Image quality | No cross-talk No chrominance non-uniformity | Horizontal cross-talk is caused. Chrominance non-uniformity is caused at low gray scale in panel having unevenness of place distribution in driving voltage. |

COMPARATIVE EXAMPLE 1

The organic electroluminescent panels used in Example 1 were driven by the reset driving in the temperature range of from −40° C. to 90° C. as shown in Table 2. The frame frequency was set at 86 Hz, the duty ratio was set at 1/64, and the number of the gray scale was set at 16 (including a black level). The driving current was 0.3 mA per pixel, which was a half of the driving current in Example 1.

In this case, horizontal cross-talk was visually recognized in the temperature range of from −40° C. to 90° C. In the case of an organic electroluminescent element that was fabricated as in Example 1 and had an unequal distribution in the driving voltage, chrominance non-uniformity was visually recognized at a low gray scale.

TABLE 2

| | Comparative Example 1 | Comparative Example 2 |
|---|---|---|
| Temperature range | −40° C. to 90° C. | −40° C. to 90° C. |
| Driving method | Reset driving method | Electric charge control driving method |
| Gray scale method | PWM | PWM |
| Driving current (mA/pixel) | 0.3 | 0.6 |
| Supply voltage | 12 V (90° C.) to 22 V (−40° C.) | 14 V (90° C.) to 26 V (−40° C.) |
| Shortest high impedance time (μs) | 0 | 78 |
| Ratio of shortest high impedance time | 0% | 43% |
| Current application time at maximum gray scale level (μs) | 176 | 98 |

TABLE 2-continued

| | Comparative Example 1 | Comparative Example 2 |
|---|---|---|
| Image quality | Horizontal cross-talk is caused. Chrominance non-uniformity is caused at low gray scale in panel having unevenness of place distribution in driving voltage. | No cross-talk No chrominance non-uniformity |

COMPARATIVE EXAMPLE 2

The organic electroluminescent panels used in Example 1 were used again and driven at a frame frequency of 86 Hz and with a duty of 1/64 by the electric charge control driving in the temperature range of from −40° C. to 90° C. The number of gray scale level was set at 16 (including a black level). As shown in Table 2, the driving current was 0.6 mA per pixel. The current application time at the maximum gray scale level as the constant current section at the maximum luminance was set at 98 μs, and the high impedance time as the length of the high impedance section at the time of the maximum gray scale level was set at 78 μs, i.e., 43% of the selection time.

In this case, neither chrominance non-uniformity nor horizontal cross-talk was visually recognized, though the supply voltage of the drive circuits was increased to 26V.

EXAMPLE 2

Among the organic electroluminescent panels used in Example 1, organic electroluminescent panels, which had a slightly unequal distribution in the driving voltage, were selected and used. In the normal time (at a high luminance), the selected panel was driven by the reset driving method under the same conditions as Comparative Example 1 as shown in Table 3. In the dimming time, the panels were driven with the driving current being lowered to 0.1 mA in the temperature range of from −40° C. to 90° C. by the electric charge driving method.

In both cases, no chrominance non-uniformity was visually recognized. The supply voltage of the drive circuit did not exceed 22 V. In other words, it was verified that the second typical example was able to offer the advantages stated earlier.

TABLE 3

| | Example 2 | |
|---|---|---|
| Driving state | Normal time | Dimming time |
| Driving method | Reset driving method | Electric charge control driving method |
| Gray scale method | PWM | PWM |
| Driving current (mA/pixel) | 0.3 | 0.1 |
| Supply voltage | 12 V (90° C.) to 22 V (−40° C.) | 12 V (90° C.) to 20 V (−40° C.) |
| Shortest high impedance time (μs) | 0 | 110 |
| Ratio of shortest high impedance time | 0% | 63% |
| Current application time at maximum gray scale level (μs) | 176 | 66 |
| Image quality | No chrominance non-uniformity | No chrominance non-uniformity |

COMPARATIVE EXAMPLE 3

In the normal time (at the high luminance), the organic electroluminescent panels used in Example 2 were driven by the reset driving method under the same conditions as Example 2 as shown in Table 4. However, the reset driving method that was performed in the dimming time was different from Example 2 in that the driving current was lowered to 0.03 mA, which was 1/10 of the driving current in the normal time.

When the panels were driven in the dimming time, chrominance non-uniformity was visually recognized. In other words, it was verified that it was not appropriate to utilize the first driving method at the dimming time.

TABLE 4

| | Comparative Example 3 | |
|---|---|---|
| Driving state | Normal time | Dimming time |
| Driving method | Reset driving method | Reset driving method |
| Gray scale method | PWM | PWM |
| Driving current (mA/pixel) | 0.3 | 0.03 |
| Supply voltage | 12 V (90° C.) to 22 V (−40° C.) | 8 V (90° C.) to 15 V (−40° C.) |
| Shortest high impedance time (μs) | 0 | 0 |
| Ratio of shortest high impedance time | 0% | 0% |
| Current application time at maximum gray scale level (μs) | 176 | 176 |
| Image quality | No chrominance non-uniformity | Chrominance non-uniformity visually recognized |

COMPARATIVE EXAMPLE 4

In the dimming time, the organic electroluminescent panel used in Example 2 were driven by the electric charge control driving method with the driving current being set at 0.1 mA as in Example 2 as shown in Table 5. However, the electric charge control driving method in the normal time (at the high luminance) was different from Example 2 in that the electric charge control driving method was performed under the same conditions as Comparative Example 2. The driving current was 0.6 mA. The current application time at the maximum gray scale level as the constant current section at the maximum luminance was set at 98 μs, and the high impedance time as the length of the high impedance section at the time of the maximum gray scale level was set at 78 μs, i.e., 43% of the selection period.

In both cases, no chrominance non-uniformity was visually recognized, though the supply voltage of the driving circuit was increased to 26 V. In other words, it was verified that when the second driving method was utilized in the normal time, the supply voltage of the drive circuit was increased.

TABLE 5

| | Comparative Example 4 | |
|---|---|---|
| Driving state | Normal time | Dimming time |
| Driving method | Electric charge control driving method | Electric charge control driving method |
| Gray scale method | PWM | PWM |
| Driving current (mA/pixel) | 0.6 | 0.1 |
| Supply voltage | 14 V (90° C.) to 26 V (−40° C.) | 12 V (90° C.) to 20 V (−40° C.) |
| Shortest high impedance time (μs) | 78 | 110 |
| Ratio of shortest high impedance time | 43% | 63% |
| Current application time at maximum gray scale level (μs) | 98 | 66 |
| Image quality | No chrominance non-uniformity | No chrominance non-uniformity |

EXAMPLE 3

In organic electroluminescent panels used in Example 1 were used again and driven by the electric charge control method in an ambient temperature range of from 0° C. to 90° C. as in Example 1 as shown in Table 6. In an ambient temperature range of from −40° C. to −1° C., the reset driving method was performed in the normal time (at the high luminance) under the same conditions as Comparative Example 1, and the electric charge control driving method was performed in the dimming time with the driving current being lowered to 0.1 mA.

The panels were driven as stated just above. In the range of from 0° C. to 90° C., no chrominance non-uniformity was visually recognized, and no cross-talk was caused as in Example 1. In the range of from −40° C. to 0° C., cross-talk was visually recognized in the normal time. When an organic electroluminescent panel having an uneven distribution in the driving voltage (non-uniformity in the driving voltage) was used, chrominance non-uniformity was visually recognized at the time of the low gray scale level. In the dimming time, no chrominance non-uniformity was visually recognized, and no cross talk was caused. Thus, it was revealed that display quality did not degrade in the normal temperature range contained in the range of from 0° C. to 90° C. The supply voltage of the drive circuits did not exceed 22 V. In other words, it was revealed that the third typical example was able to offer the advantages stated earlier.

In Example 1 to Example 3, the maximum voltage of the supply voltage of the driving circuits under the second driving method was not higher than the maximum voltage under the first driving method as shown in Table 1, Table 3 and Table 6.

TABLE 6

| | Example 3 | | |
|---|---|---|---|
| Temperature range | 0° C. to 90° C. | −40° C. to 0° C. | |
| Driving state | Normal time and dimming time | Normal time | Dimming time |
| Driving method | Electric charge control driving method | Reset driving method | Electric charge control driving method |
| Gray scale method | PWM | PWM | PWM |
| Driving current (mA/pixel) | 0.6 | 0.3 | 0.1 |
| Supply voltage | 14 V (90° C.) to 22 V (0° C.) | 18 V (−1° C.) to 22 V (−40° C.) | 16 V (−1° C.) to 20 V (−40° C.) |
| Shortest high impedance time (μs) | 78 | 0 | 110 |
| Ratio of shortest high impedance time | 43% | 0% | 63% |
| Current application time at maximum gray scale level (μs) | 98 | 176 | 66 |
| Image quality | No cross-talk No chrominance non-uniformity | Horizontal cross-talk is caused. Chrominance non-uniformity is caused at low gray scale in panel having unevenness of place distribution in driving voltage. | No cross-talk No chrominance non-uniformity |

Table 7 and Table 8 show the results that are obtained by collecting the results of these examples (Example 1 to Example 3) and comparative examples. Results that can be obtained in analogy with these examples and comparative examples are also shown, though not presented as Examples or Comparative Examples. In Table 7 and Table 8, the phrase "Panel level C" means the organic electroluminescent panels used in Example 1 and Example 3, and the phrase "Panel level B" means the organic electroluminescent panels used in Example 2. The organic electroluminescent panels classified as "Panel level B" are ones that are free from non-uniformity in the voltage among the organic electroluminescent panels used in Example 1 and Example 3. In other words, the organic electroluminescent panels classified as "Panel level B" has improved performance in comparison with the organic electroluminescent panels classified as "Panel level C".

TABLE 7

| | | Conventional driving method | | Electric charge control driving method | |
|---|---|---|---|---|---|
| | | Normal time | Dimming time | Normal time | Dimming time |
| Panel level C (with non-uniformity in voltage) | Room temperature to high temperature | X | X *1 | ○ | ○ |

TABLE 7-continued

| | | Conventional driving method | | Electric charge control driving method | |
|---|---|---|---|---|---|
| | | Normal time | Dimming time | Normal time | Dimming time |
| | Low temperature | X | X *1 | ○ | ○ |
| Panel level B (with non-uniformity in voltage improved) | Room temperature to high temperature | ○ | Δ | ○ | ○ |
| | | ○ | Δ | ○ | ○ |
| | Low temperature | ○ | Δ | ○ | ○ |
| Supply voltage | | ○ *2 | ○ *2 | X *2 | X *2 |

○: Neither horizontal cross-talk nor chrominance non-uniformity was caused.

Δ: No horizontal cross-talk was caused, though chrominance non-uniformity was caused.

X: Horizontal cross-talk and chrominance non-uniformity were caused.

X *1: No horizontal cross-talk was caused, and chrominance non-uniformity was greatly caused.

○ *2: Supply voltage of driving circuit was low.

X *2: Supply voltage of driving circuit was high.

TABLE 8

| | | Type (1) Switching at temperature | | Type (2) Switching at dimming time | | Types (1) & (2) | |
|---|---|---|---|---|---|---|---|
| | | Normal time | Dimming time | Normal time | Dimming time | Normal time | Dimming time |
| Panel level C (with non-uniformity in voltage) | Room temperature to high temperature | ○ | ○ | X | ○ | ○ | ○ |
| | Low temperature | X | X *1 | X | ○ | X | ○ |
| Panel level B (with non-uniformity in voltage improved) | Room temperature to high temperature | ○ | ○ | ○ | ○ | ○ | ○ |
| | Low temperature | ○ | Δ | ○ | ○ | ○ | ○ |
| Supply voltage | | ○ *2 | ○ *2 | ○ *2 | ○ *2 | ○ *2 | ○ *2 |

○: Neither horizontal cross-talk nor chrominance non-uniformity was caused.

Δ: No horizontal cross-talk was caused, though chrominance non-uniformity was caused.

X: Horizontal cross-talk and chrominance non-uniformity were caused.

X *1: No horizontal cross-talk was caused, and chrominance non-uniformity was greatly caused.

○ *2: Supply voltage of driving circuit was low.

X *2: Supply voltage of driving circuit was high.

In Table 7, the phrase "Conventional driving method" means the first driving method, such as the reset driving method. Table 7 shows the display quality in each of a case wherein the conventional driving method was performed in all temperature ranges and all luminance ranges and a case wherein the electric charge control driving method was performed in all temperature ranges and all luminance ranges. Table 8 shows the display quality in a case wherein the electric charge control driving method was performed in all temperature ranges and all luminance ranges.

In Table 8, the phrase "Type (1)" corresponds to Example 1 and its comparative example, and the phrase "Type (2)" corresponds to Example 2 and its comparative example. The phrase "Type (1) & (2)" corresponds to Example 3. The phrase "Switching at temperature" means that the first driving method and the second driving method are switched in accordance with a temperature (0° C. as the boundary value in these cases). As seen from Table 7 and Table 8, the present invention can offer its advantages with respect to at least Type (1) even when the performance of an organic electroluminescent panel per se is improved. When an organic electroluminescent panel having substantially the same performance as the panels used in Example 1 and Example 3 and classified as "Panel level C" is used, the present invention is particularly effective.

In accordance with the driving method of the present invention, the electric charge control driving method is utilized when the ambient temperature is higher than a certain temperature. As a result, it is possible not only to prevent the driving voltage from increasing but also to improve the display quality of an organic electroluminescent display device in the temperature range wherein organic electroluminescent display devices are normally used.

Additionally, the electric charge control driving method is also utilized when the light-emission luminance is relatively low. As a result, it is possible to prevent the driving voltage from increasing but also to prevent a decrease in the display quality at a low luminance wherein chrominance non-uniformity and so on can be visually recognized in an easy fashion.

The entire disclosure of Japanese Patent Application No. 2003-033006 filed on Feb. 10, 2003 including specification, claims, drawings and summary is incorporated herein by reference in its entirety.

The invention claimed is:

1. A method for driving an organic electroluminescent display device, which has a set of row electrodes and a set of column electrodes provided in a matrix pattern, and an organic electroluminescent element sandwiched between both sets; comprising:

driving the organic electroluminescent element by an electric charge control driving method when an ambient temperature is higher than a prescribed temperature, the electric charge control driving method comprising supplying electric charges to a column electrode in the set of column electrodes and then placing an output from a driving circuit to the column electrode in the set of column electrodes in a high impedance state;

driving the organic electroluminescent element by the electric charge control driving method when the ambient temperature is not higher than the prescribed temperature and when a light-emission luminance in a maximum gray scale is a relatively low luminance; and driving the organic electroluminescent element by a capacitive charge driving method when the ambient temperature is not higher than the prescribed temperature and when the light-emission luminance in the maximum gray scale is a relatively high luminance, the capacitive charge driving method comprising supplying a constant current to the column electrode in the set of column electrodes after performing the capacitance charge, and then applying a constant voltage to the column electrode in the set of column electrodes to turn off a pixel.

2. The method according to claim 1, wherein when the ambient temperature is not higher than the prescribed temperature and when a rated luminance is defined as 100%, a light-emission luminance when switching between both driving methods has a value of 40% to 60% of the rated luminance.

3. The method according to claim 1, wherein the prescribed temperature is in a temperature range of from −10° C. to +10° C.

4. The method according to claim 1, wherein a maximum voltage of a supply voltage of the driving circuit is not higher than 25 V.

* * * * *